US007600860B2

(12) United States Patent
Sanada

(10) Patent No.: US 7,600,860 B2
(45) Date of Patent: Oct. 13, 2009

(54) LIQUID EJECTION HEAD AND IMAGE FORMING APPARATUS

(75) Inventor: Kazuo Sanada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 476 days.

(21) Appl. No.: 11/453,106

(22) Filed: Jun. 15, 2006

(65) Prior Publication Data

US 2006/0284937 A1 Dec. 21, 2006

(30) Foreign Application Priority Data

Jun. 17, 2005 (JP) ..... 2005-177936

(51) Int. Cl.
*B41J 2/045* (2006.01)

(52) U.S. Cl. ..... 347/70

(58) Field of Classification Search ..... 347/70, 347/68–69, 71–72

See application file for complete search history.

(56) References Cited

U.S. PATENT DOCUMENTS 6,488,355 B2 12/2002 Nakamura et al.
6,742,875 B2 * 6/2004 Usui et al. ..... 347/72
2002/0080215 A1 6/2002 Sakaida et al.
2003/0071874 A1 4/2003 Ishizawa et al.
2004/0090498 A1 5/2004 Sakaida et al.
2005/0185030 A1 * 8/2005 Hoisington et al. ..... 347/71
2006/0012645 A1 * 1/2006 Nagashima ..... 347/68

FOREIGN PATENT DOCUMENTS

JP 2001-334661 A 12/2001
JP 2002-79683 A 3/2002
JP 2002-166543 A 6/2002

* cited by examiner

*Primary Examiner*—K. Feggins
(74) *Attorney, Agent, or Firm*—Birch, Stewart, Kolasch & Birch, LLP

(57) ABSTRACT

The liquid ejection head comprises: a plurality of nozzles through which liquid is ejected in an ejection direction; a plurality of pressure chambers which are connected respectively to the nozzles and filled with the liquid; and a plurality of piezoelectric elements which are provided respectively for the pressure chambers, the piezoelectric elements deforming to pressurize and cause the liquid in the pressure chambers to be ejected through the nozzles, the piezoelectric elements being substantially thin plate-shaped and layered in a thickness direction of the piezoelectric elements, the thickness direction being substantially perpendicular to the ejection direction.

14 Claims, 20 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly, to a liquid ejection head and an image forming apparatus for which nozzles are disposed in high-density.

2. Description of the Related Art

An inkjet recording apparatus (inkjet printer) is known which performs so-called inkjet image recording in which an image is recorded by forming dots on a recording medium by ejecting liquid droplets (ink droplets) from a plurality of nozzles formed in a print head (also simply called "head") while moving the head and the recording medium relatively with respect to each other.

Ink ejection methods in a head include: a thermal method in which heating elements (electrical-thermal energy conversion devices) are provided in the vicinity of the nozzles, the ink being heated locally by applying an electrical signal to each heating element, thereby creating a pressure change which causes ink droplets to be ejected from the nozzle; and a piezoelectric method in which electrical-pressure conversion devices, such as piezoelectric elements, are used to apply a mechanical pressure to the ink, thereby causing ink droplets to be ejected from the nozzle.

In order to make the head using the piezoelectric method possible to eject a prescribed liquid droplet (volume), the piezoelectric body constituting each piezoelectric element must have a prescribed surface area. For example, in order to eject a liquid droplet of several picoliters (pl), it is necessary to adopt a design in which the surface area of the piezoelectric body is approximately 0.1 $mm^2$ to several tenths of 1 $mm^2$. Therefore, the density of the nozzles which can be arranged in one row in the piezoelectric type of head is low compared to the thermal type of head, and is 180 nozzles per inch (npi), for example.

Then, heads in which nozzles are arranged in a two-dimensional configuration (matrix array) have been proposed (see, for example, Japanese Patent Application Publication Nos. 2001-334661, 2002-166543 and 2000-79683). The planar shape of the piezoelectric bodies is substantially rhombic or square, and by arranging a plurality of nozzle rows of medium density of the order of 30 npi, a high effective nozzle density (the nozzle density of the projected nozzle row obtained by projecting the nozzles in the direction of the nozzle rows), for example, 1200 npi to 2400 npi, is achieved.

However, the heads in the related art have problems as follows.

FIG. 20 is a plan view perspective diagram showing an example of a head in the related art. As shown in FIG. 20, the head 150 includes nozzles 151, pressure chambers 152 corresponding to the nozzles 151, and piezoelectric elements 158 having substantially the same shape as the pressure chambers 152, arranged in a two-dimensional configuration following the main scanning direction and an oblique direction which is not perpendicular to the main scanning direction. In this case, the projected nozzle row obtained by projecting the nozzles to an alignment in the main scanning direction is arranged at a uniform nozzle pitch P0. On the other hand, with regard to the nozzles 151 that are mutually adjacent in the projected nozzle row, the nozzle pitch is P1 in the sub-scanning direction between nozzles 151 that are aligned in the oblique direction (for example, between nozzles 151-11 and 151-12 and between nozzles 151-15 and 151-16, in nozzle row 154-1, and so on), whereas the nozzle pitch is P2, which is greater than P1 (i.e., P2>P1), in the sub-scanning direction between the nozzles 151 situated at the junctures (return positions) between nozzle columns 154 that are adjacent in the main scanning direction (for example, between the nozzle 151-16 of the nozzle column 154-1 and the nozzle 151-21 of the nozzle column 154-2).

In order to achieve high nozzle density in the head 150, as stated previously, the surface area of the piezoelectric bodies constituting the piezoelectric elements must be set to a prescribed size, and hence the size of the head 150 in the sub-scanning direction is inevitably enlarged. More specifically, the nozzle pitch P1 in the sub-scanning direction becomes larger, and consequently, the nozzle pitch P2 in the sub-scanning direction at the junctures also becomes larger. Consequently, there is a problem in that, if there is error in the installation position of the head, skewing of the paper feed direction or contraction of the recording medium due to cockling, or the like, then streaks extending in the paper feed direction (sub-scanning direction) are readily visible in the image formed on the recording medium around the positions corresponding to the junctures in the head.

It has been proposed that streaks occurring around the positions corresponding to the junctures can be made inconspicuous by adjusting the nozzle arrangement in the head suitably, or the like, but this gives rise to restrictions, for instance, it makes the flow channel structure inside the head more complicated.

SUMMARY OF THE INVENTION

The present invention has been contrived in view of the foregoing circumstances, an object thereof being to provide a liquid ejection head and image forming apparatus with a high-density nozzle arrangement in which the visibility of streaks in the formed image can be reduced.

In order to attain the aforementioned object, the present invention is directed to a liquid ejection head, comprising: a plurality of nozzles through which liquid is ejected in an ejection direction; a plurality of pressure chambers which are connected respectively to the nozzles and filled with the liquid; and a plurality of piezoelectric elements which are provided respectively for the pressure chambers, the piezoelectric elements deforming to pressurize and cause the liquid in the pressure chambers to be ejected through the nozzles, the piezoelectric elements being substantially thin plate-shaped and layered in a thickness direction of the piezoelectric elements, the thickness direction being substantially perpendicular to the ejection direction.

According to the present invention, the plane on which the piezoelectric elements are arranged and the plane on which the nozzles are arranged are mutually perpendicular, and even if a large surface area is ensured for the piezoelectric elements, it is still possible to make the nozzle pitch small. Accordingly, it is possible to arrange the piezoelectric elements in the thickness direction, and hence the head size can be reduced in the thickness direction of the piezoelectric elements in the liquid ejection head with high density nozzle arrangement. Therefore, the visibility of streaks in the formed image can be reduced.

Preferably, the piezoelectric elements are polarized in the thickness direction of the piezoelectric elements; and the piezoelectric elements deform when an electric field is applied in the thickness direction.

According to this aspect of the present invention, in a state where the head size is small in the thickness direction of the piezoelectric elements, and the surface area of the piezoelectric elements is set to a prescribed large size, then it is possible to obtain a large displacement of the piezoelectric elements, without changing (increasing) the voltage applied per unit of electric field strength.

Preferably, the piezoelectric elements are arranged in a plurality of rows substantially perpendicular to the thickness direction of the piezoelectric elements; and the rows are arranged in the thickness direction.

According to this aspect of the present invention, it is possible to arrange the plurality of piezoelectric elements at high density in a two-dimensional fashion.

Preferably, the liquid ejection head is a line head in which the nozzles are two-dimensionally arranged through a length corresponding to a full width of a recording medium; and the thickness direction of the piezoelectric elements is parallel to a direction of relative conveyance of the recording medium with respect to the liquid ejection head.

According to this aspect of the present invention, the nozzle pitch of the line head in the relative conveyance direction is small, and it is possible to reduce the visibility of the streaks extending in the relative conveyance direction of the paper at the juncture positions in the head.

Preferably, the liquid ejection head further comprises a plurality of unit members which include the piezoelectric elements and the pressure chambers, the unit members being substantially thin plate-shaped and layered in the thickness direction of the piezoelectric elements.

According to this aspect of the present invention, the manufacture of the liquid ejection head is simplified.

Preferably, the liquid ejection head further comprises a nozzle plate which is formed with holes respectively corresponding to the nozzles and is arranged on a side face of the layered unit members, the side face being parallel to the thickness direction of the piezoelectric elements.

According to this aspect of the present invention, it is possible to prevent decline in the accuracy of the nozzle forming positions due to error in the layering and assembly of the unit members.

Preferably, each of the unit members further includes: a cavity plate which is formed with holes corresponding respectively to the pressure chambers; a diaphragm which seals off a face of each of the holes in the cavity plate, the piezoelectric elements being disposed on a side of the diaphragm reverse to a side thereof adjacent to the holes in the cavity plate; and a base plate which seals off the other face of each of the holes in the cavity plate.

According to this aspect of the present invention, the manufacture of the unit members is simplified.

Preferably, the cavity plate has supply ports through which the liquid is supplied to the pressure chambers.

According to this aspect of the present invention, there is no need to provide the supply ports in the diaphragm, and hence the freedom of choice of the material used for the diaphragm is improved.

Preferably, each of the unit members further includes a protective plate which is formed with at least one of recesses and grooves for preventing restriction of deformation of the piezoelectric elements.

According to this aspect of the present invention, the ejection characteristics of the liquid ejection head are improved.

Preferably, each of the unit members further includes electrical wires through which driving signals are applied to the piezoelectric elements, the electrical wires being arranged on at least one of the protective plate and the cavity plate.

According to this aspect of the present invention, sufficient electrical wiring space can be ensured and the difficulty of wiring is reduced.

Preferably, each of the unit members further includes a drive circuit which drives the piezoelectric elements, the drive circuit being arranged on the at least one of the protective plate and the cavity plate.

According to this aspect of the present invention, it is possible to adopt a closed circuit composition for each of the unit members.

Preferably, each of the unit members has a flow channel through which the liquid circulates.

According to this aspect of the present invention, increase in the viscosity of the liquid in the liquid ejection head is prevented, and ejection quality is improved.

Preferably, each of the unit members further includes a plurality of pressure sensors which determine pressure change in the liquid filled in the pressure chambers, respectively.

According to this aspect of the present invention, since pressure variation caused by bubbles in the pressure chambers can be determined, then the ejection quality is improved.

In order to attain the aforementioned object, the present invention is also directed to an image forming apparatus, comprising the above-described liquid ejection head.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Inkjet Recording Apparatus

Figure 1:
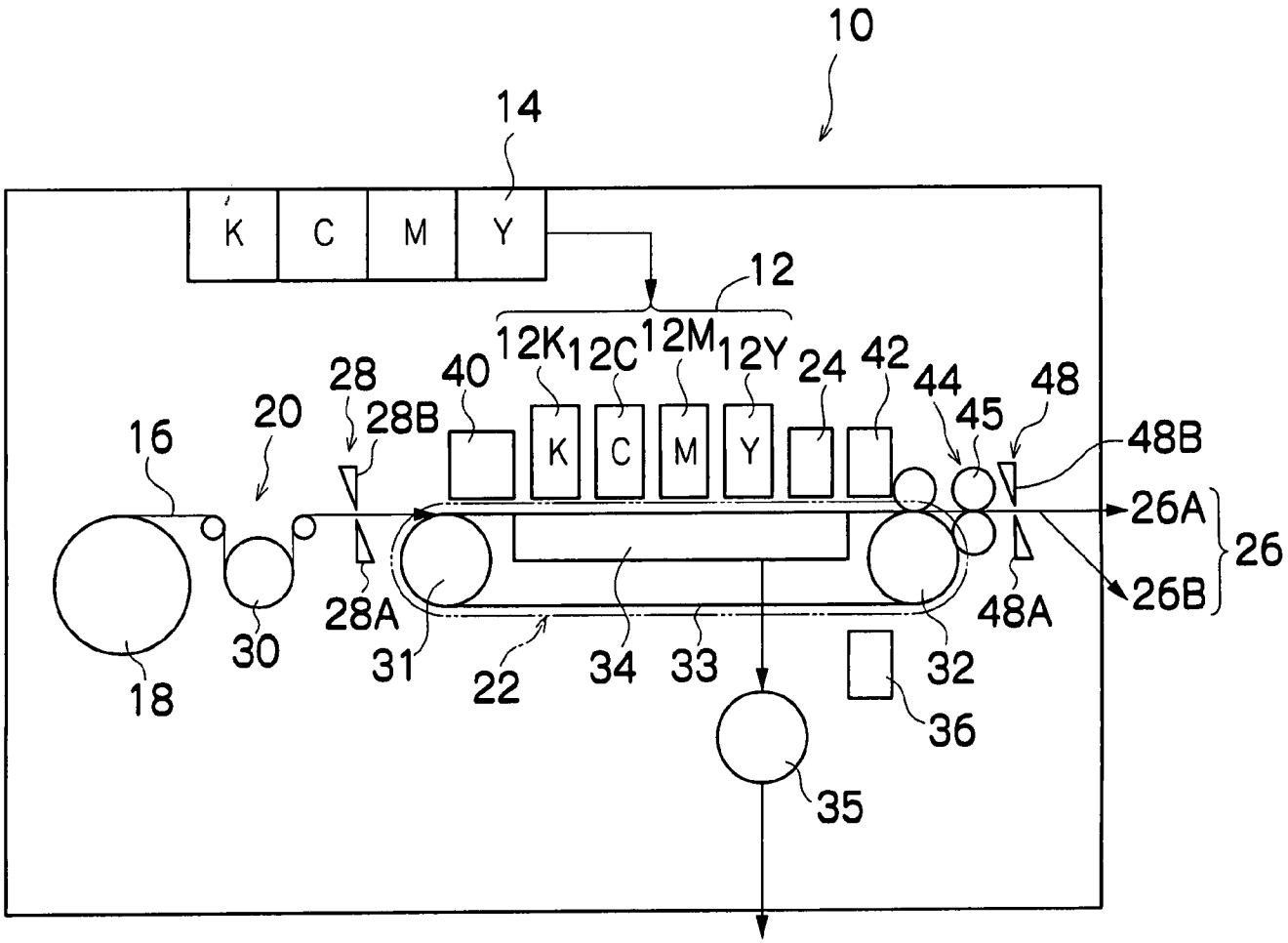
FIG. 1 is a general schematic drawing of an inkjet recording apparatus according to an embodiment of the present invention.

FIG. 1 is a general schematic illustration of an inkjet recording apparatus which forms an image forming apparatus according to an embodiment of the present invention. As shown in FIG. 1, the inkjet recording apparatus 10 comprises: a printing unit 12 having a plurality of print heads 12K, 12C, 12M, and 12Y for ink colors of black (K), cyan (C), magenta (M), and yellow (Y), respectively; an ink storing and loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an embodiment of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a flat plane (a flat surface).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, embodiments thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). The print heads 12K, 12C, 12M and 12Y forming the print unit 12 are constituted by line heads in which a row of ink ejection ports (nozzles) is arranged through a length exceeding at least one edge of the maximum size recording paper 16 intended for use with the inkjet recording apparatus 10.

The print heads 12K, 12C, 12M, and 12Y are arranged in the order of black (K), cyan (C), magenta (M), and yellow (Y) from the upstream side (the left-hand side in FIG. 1), along the conveyance direction of the recording paper 16 (paper conveyance direction). A color image can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relative to each other in the paper conveyance direction (sub-scanning direction) just once (in other words, by means of a single sub-scan). Higher-speed printing is thereby made possible and productivity can be improved in comparison with a shuttle type head configuration in which a print head moves reciprocally in the direction (main scanning direction) that is perpendicular to paper conveyance direction.

Although the configuration with the KCMY four standard colors is described in the present embodiment, combinations of the ink colors and the number of colors are not limited to those. Light inks or dark inks can be added as required. For example, a configuration is possible in which inkjet heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M, 12Y, through a tube channel (not shown). Moreover, the ink storing and loading unit 14 also comprises a notifying device (display device, alarm generating device, or the like) for generating a notification if the remaining amount of ink has become low, as well as having a mechanism for preventing incorrect loading of ink of the wrong color.

The print determination unit 24 shown in FIG. 1 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, and 12Y This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the print heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Print Head

Next, various embodiment of a print head (liquid ejection head) to which the present invention is applied are described. The print heads 12K, 12C, 12M and 12Y provided for the respective ink colors have the same structure, and a reference numeral 50 is hereinafter designated to any of the print heads 12K, 12C, 12M and 12Y.

First Embodiment

Figure 2:
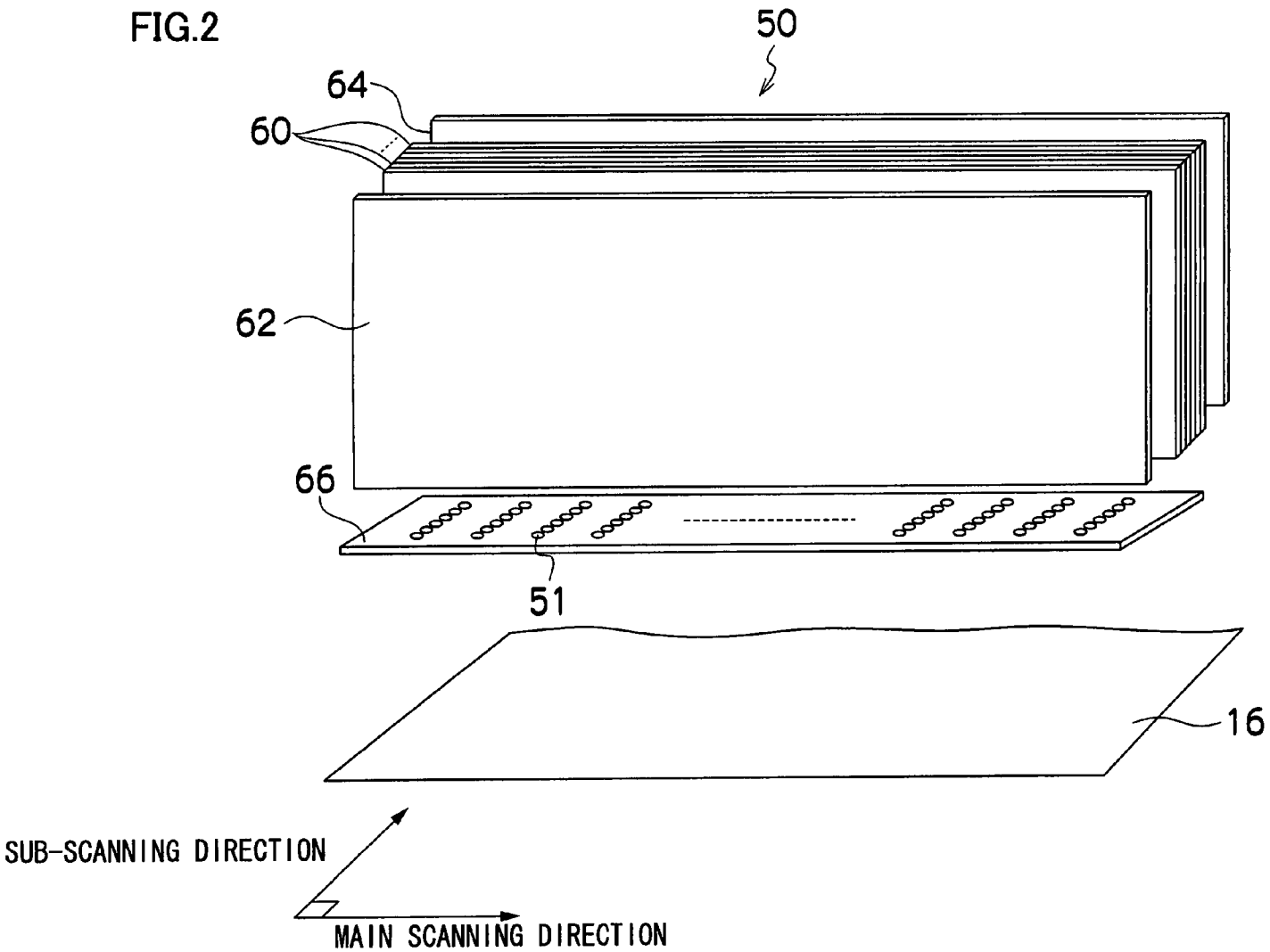
FIG. 2 is an oblique diagram showing an exploded view of a portion of a print head according to a first embodiment.

FIG. 2 is an oblique diagram showing an exploded view of a portion of a print head 50 according to a first embodiment. The print head 50 shown in FIG. 2 is principally constituted by a plurality of thin plate-shaped flow channel units 60 (there are six units in the present embodiment), two partition plates 62 and 64, and a nozzle plate 66, in which a plurality of nozzles 51 are formed. The plurality of flow channel units 60 are layered in the thickness direction thereof, and they are layered in the sub-scanning direction in the present embodiment, which direction is conveyance direction of the recording paper 16. The flow channel units 60 are arranged between the two partition plates 62 and 64. The nozzle plate 66 is disposed in a substantially perpendicular fashion with respect to the flow channel units 60 and the two partition plates 62 and 64, and the nozzle plate 66 constitutes the surface of the print head 50 that faces the recording paper 16 (namely, the ink ejection surface).

Figure 3:
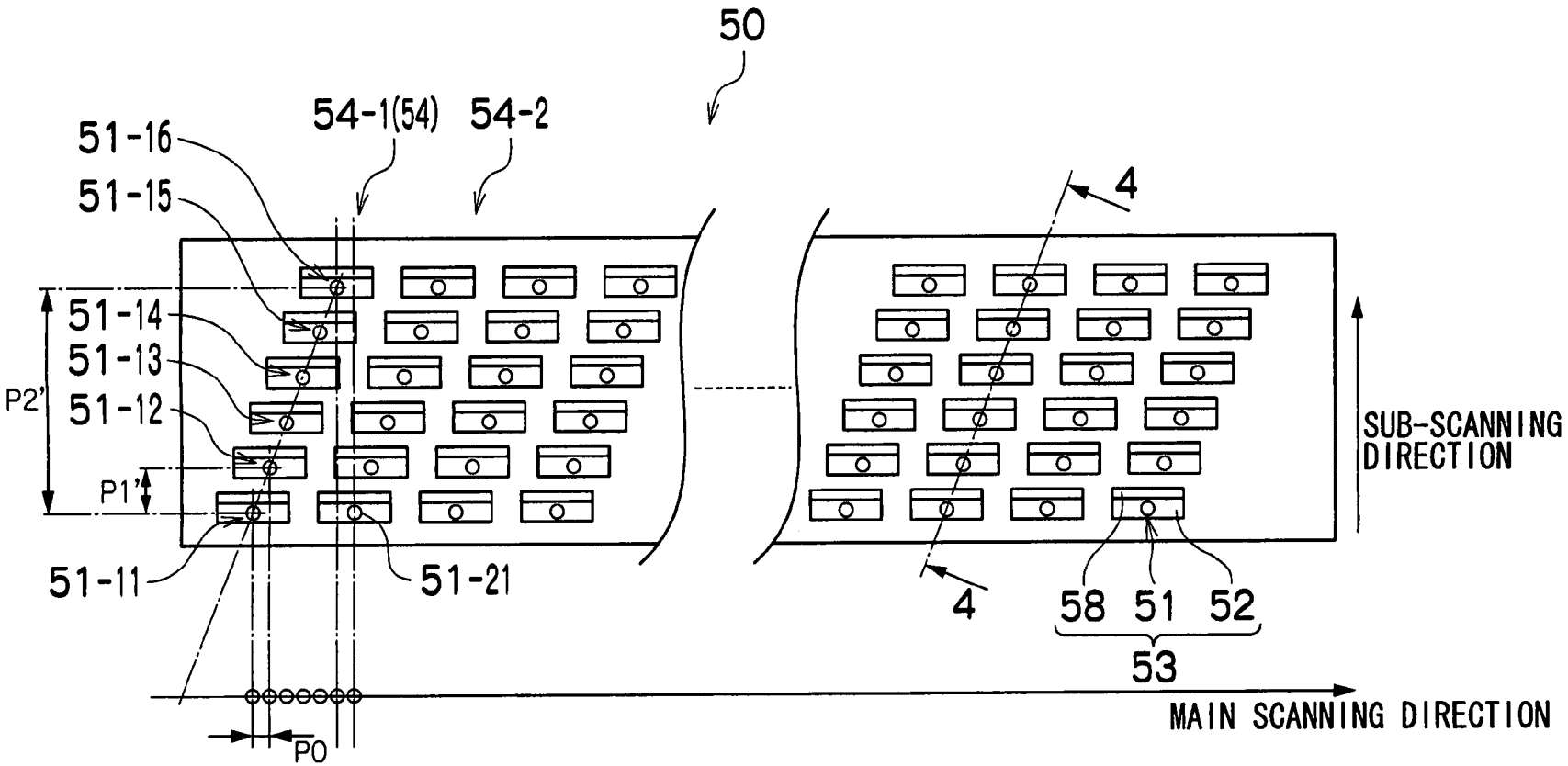
FIG. 3 is a plan view perspective diagram of an ink ejection surface of the print head.

FIG. 3 is a plan view perspective diagram of the ink ejection surface of the print head 50, and shows a simplified view in order that the arrangement of the nozzles 51, and the like, can be readily understood. As shown in FIG. 3, liquid droplet ejection elements 53 are each constituted by the nozzles 51, pressure chambers 52 and piezoelectric elements 58, and are arranged in a two-dimensional configuration (matrix array) following a main scanning direction which is perpendicular to the conveyance direction of the recording paper 16, and an oblique direction which is not perpendicular to the main scanning direction. Consequently, the projected nozzle row obtained by projecting the nozzles to an alignment in the main scanning direction has nozzles arranged equidistantly at a nozzle pitch P0, and hence a high effective density is obtained.

As shown in FIG. 3, the shape of the pressure chambers 52 when the print head 50 is viewed from the ink ejection side is a substantially rectangular shape in which the length in the sub-scanning direction is shorter than the length in the main scanning direction (namely, the shape that is elongated in the main scanning direction). Similarly, the shape of the piezoelectric elements 58 is also substantially a rectangular shape in which the length in the sub-scanning direction is shorter than the length in the main scanning direction (namely, the shape that is elongated in the main scanning direction).

Figure 20:
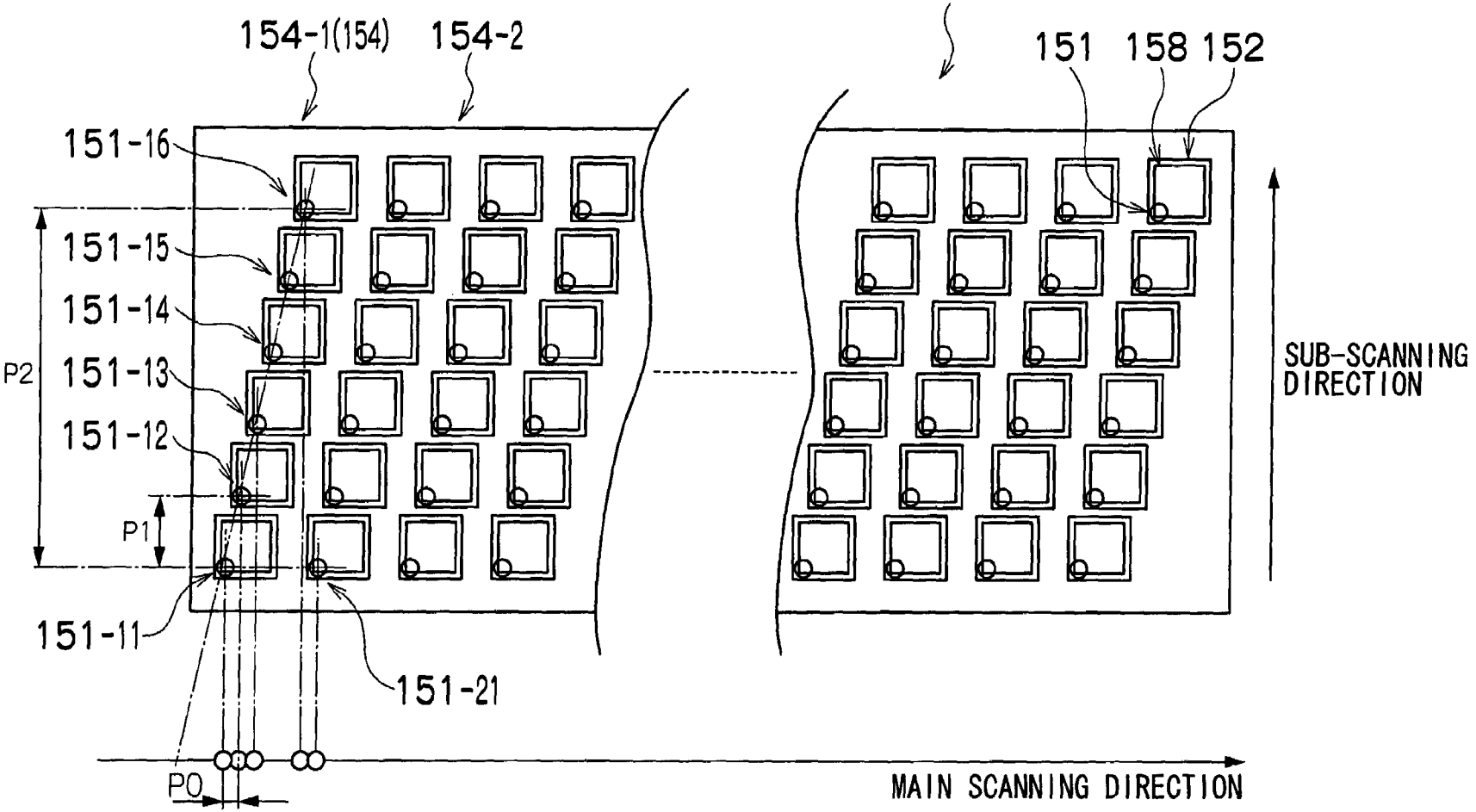
FIG.20 RELATED ART
FIG. 20 is a plan view perspective diagram showing an example of a head in the related art.

The nozzle pitch P1' between nozzles that are adjacent in the projected nozzle row formed by projecting the nozzles to an alignment in the main scanning direction, and that are located in the same nozzle column 51 in the nozzle row 54 aligned in the oblique direction (for example, between the nozzles 51-11 and 51-12, or the nozzles 51-15 and 51-16 in the nozzle column 54-1, or the like), is smaller than the nozzle pitch P1 in the related art (see FIG. 20) (i.e., P1'<P1), and therefore, the nozzle pitch P2' between the nozzles 51 situated at the junctures (return positions) between the nozzle columns 54 that are mutually adjacent in the main scanning direction (for example, between the nozzle 51-16 in the nozzle column 54-1 and the nozzle 51-21 in the nozzle column 54-2) is also smaller than the nozzle pitch P2 in the related art (see FIG. 20) (i.e., P2'<P2). Hence, the head size in the sub-scanning direction according to the present embodiment can be shorter than in the head in the related art. The composition of the pressure chambers 52 and the piezoelectric elements 58 for achieving this composition is described in detail below.

Figure 4:
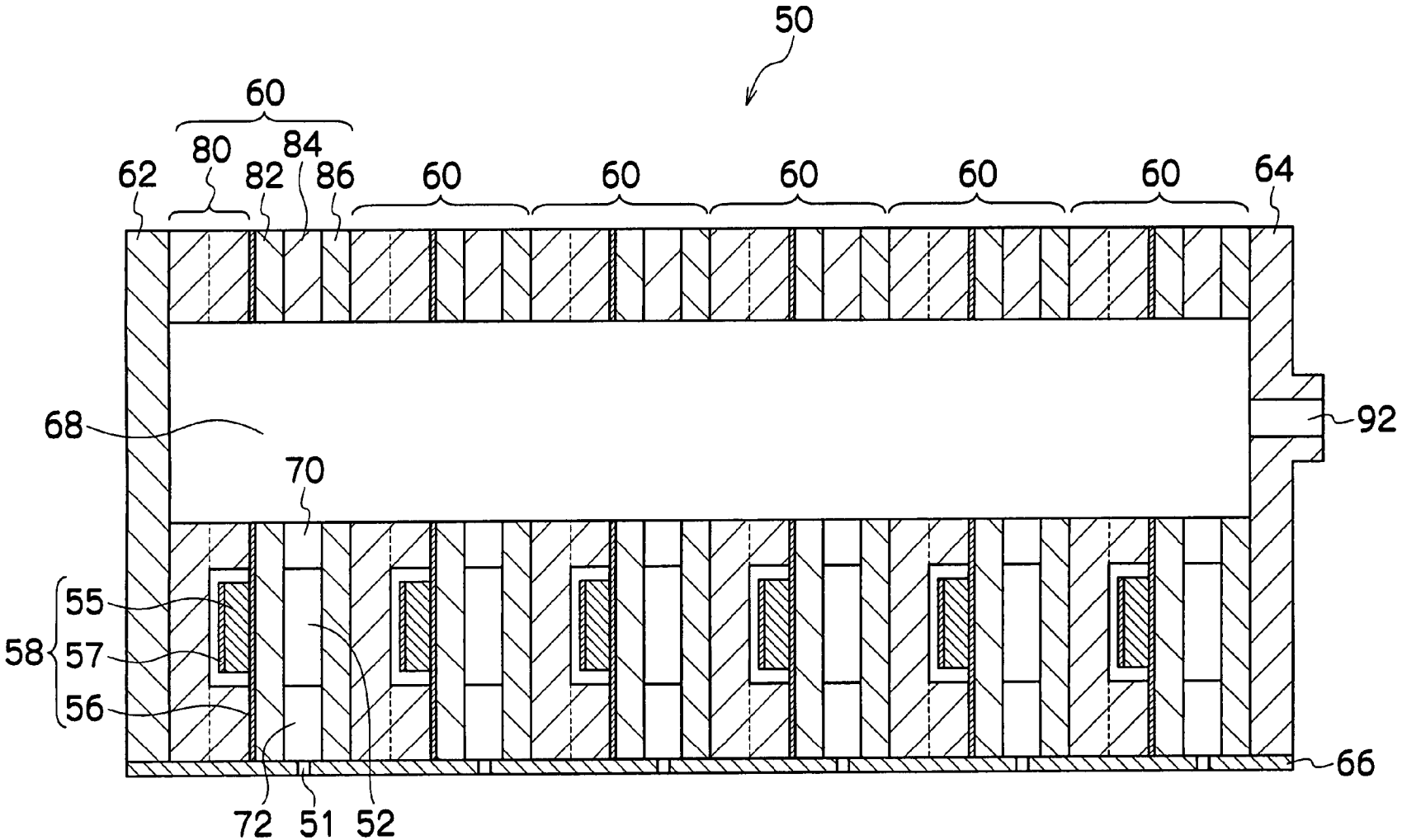
FIG. 4 is a cross-sectional diagram along line 4-4 in FIG. 3.

FIG. 4 is a cross-sectional diagram along line 4-4 in FIG. 3. As stated previously, the print head 50 according to the first embodiment is constituted by arranging the laminated body comprising the plurality of flow channel units 60 between the two partition plates 62 and 64, and furthermore, by disposing the nozzle plate 66 in a substantially perpendicular fashion with respect to the flow channel units 60 and the partition plates 62 and 64.

A desirable mode of the present embodiment is one in which the nozzle plate 66 is provided, but the present invention is not limited to this and it is also possible to provide the nozzles 51 directly in the flow channel units 60 as described later with reference to FIG. 15. If the nozzle plate 66 is provided as in the present embodiment, then it is possible to prevent decline in the accuracy of the nozzle formation positions, and hence the ejection performance of the print head 50 is improved.

A common flow channel 68 extending in the horizontal direction in FIG. 4, the plurality of pressure chambers 52 connected to the common flow channel 68, and thin plate-shaped piezoelectric elements 58 corresponding respectively to the pressure chambers 52 are provided inside the print head 50. One end of the common flow channel 68 (the left-hand end in FIG. 4) is sealed by the partition plate 62, and at the other end (the right-hand end in FIG. 4), an ink supply port 92 is formed in the partition plate 64. Ink is supplied to the common flow channel 68 through the ink supply port 92 from a tank (not shown) in the ink storing and loading unit 14 shown in FIG. 1.

Each of the pressure chambers 52 is connected to the common flow channel 68 through a supply port 70, and has an elongated shape in the vertical direction in FIG. 4. Each pressure chamber 52 is connected to the nozzle 51 through a nozzle flow channel 72, on the opposite side to the side where the supply port 70 is formed (namely, the lower side in FIG. 4). The direction of ejection of the ink droplets ejected from the nozzle 51 (ink ejection direction) is substantially perpendicular to the direction of layering of the flow channel units 60.

The thickness direction of the thin plate-shaped piezoelectric elements 58 is parallel to the direction of layering of the flow channel units 60 (the horizontal direction in FIG. 4), and the plurality of (six in this embodiment) pressure chambers 52 (piezoelectric elements 58) are arranged in this direction of layering (the thickness direction of the piezoelectric elements 58). Therefore, a composition can be achieved in which the head size is reduced in the thickness direction of the piezoelectric elements 58. In the present embodiment, since the direction of layering of the flow channel units 60 is parallel to the sub-scanning direction (see FIG. 2), then the head size is shortened in the sub-scanning direction.

Each of the flow channel units 60 is constituted by layering together four plate members (80, 82, 84 and 86), and is provided with the pressure chamber 52 and the piezoelectric element 58. The piezoelectric element 58 is disposed on a diaphragm 82, which constitutes one wall of the pressure chamber 52, and has a structure in which a thin plate-shaped piezoelectric body 55 is arranged between electrodes 56 and 57 (a common electrode 56 and an individual electrode 57). The piezoelectric elements 58 are polarized in the horizontal direction in FIG. 4, which is their thickness direction. When an electric field is applied in parallel with this direction of polarization, then the piezoelectric element 58 generates a distortion in the elastic mode (longitudinal vibration mode), and the diaphragm 82 on which the piezoelectric element 58 is disposed is caused to deform so as to bend in toward the side of the pressure chamber 52.

Figure 5:
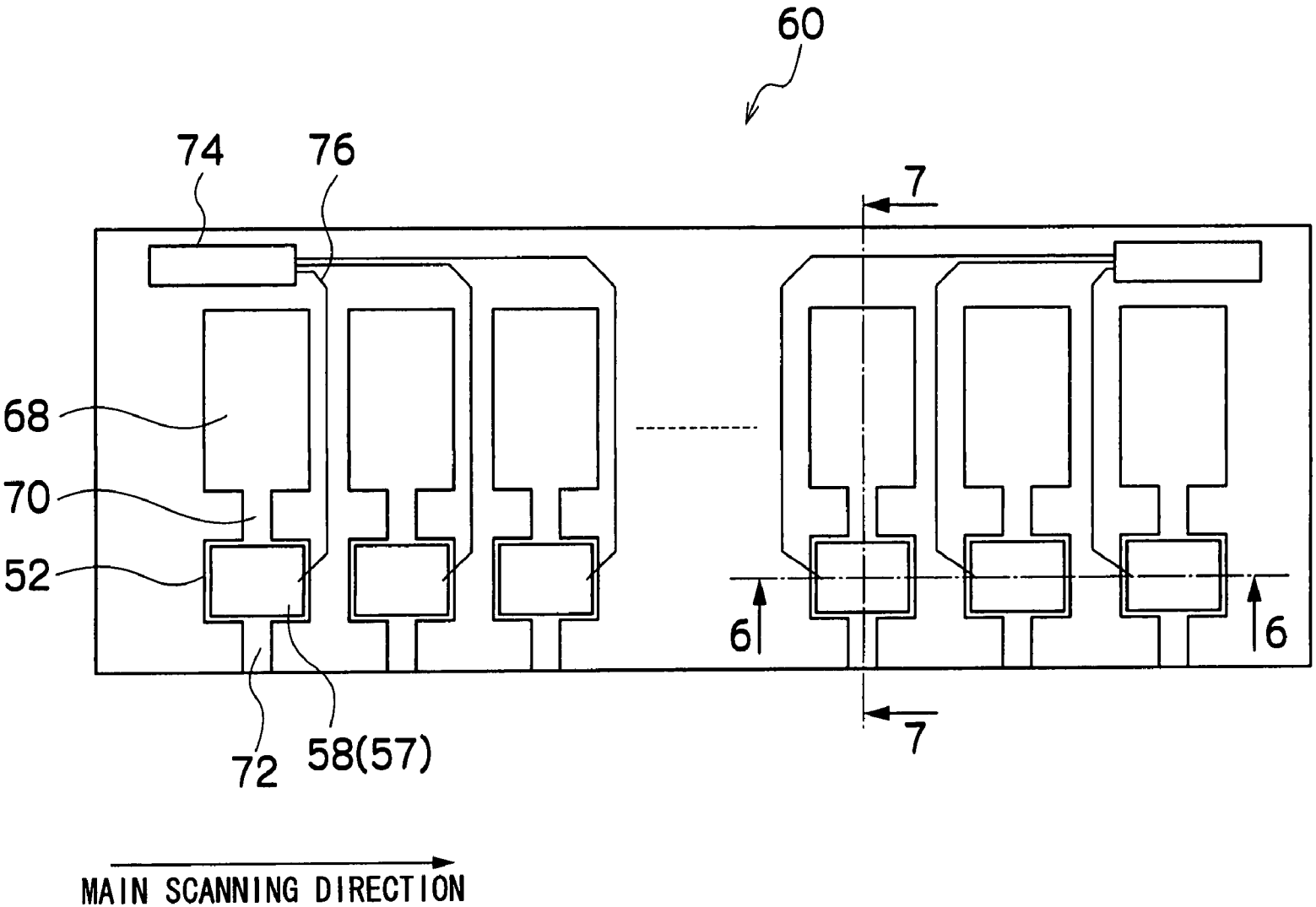
FIG. 5 is a plan view perspective diagram of a flow channel unit.

FIG. 5 is a plan view perspective diagram of one of the flow channel units 60, and shows a state where the flow channel unit 60 is viewed from the left-hand side in FIG. 4. The plurality of common flow channels 68 having a substantially rectangular shape are formed in the flow channel unit 60 along the longitudinal direction thereof so as to pass through both surfaces of the flow channel units 60. Each common flow channel 68 is connected to the substantially square pressure chamber 52 through the supply port 70. The pressure chamber 52 is connected to the nozzle 51 (not shown in FIG. 5) through the nozzle flow channel 72, at the end section on the side opposite to the side connected to the common flow channel 68 (in other words, the lower side in FIG. 5).

The piezoelectric elements 58 having a planar shape substantially similar to the pressure chambers 52 are provided in positions corresponding to the respective pressure chambers 52. Furthermore, a drive circuit 74 for driving the piezoelectric elements 58 is provided, and the individual electrodes 57 of the piezoelectric elements 58 are electrically connected to the drive circuit 74 through electrical wires (internal wires) 76.

Figure 6:
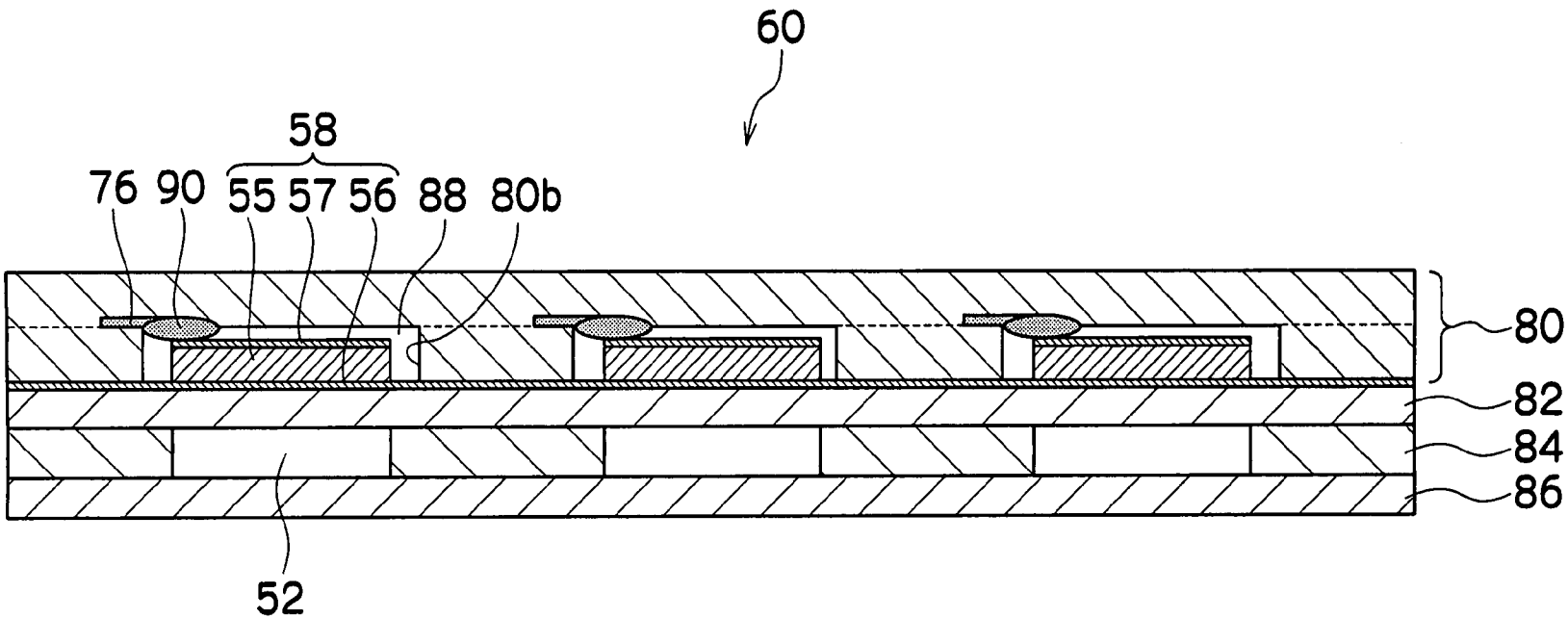
FIG. 6 is a cross-sectional diagram along line 6-6 in FIG. 5.

FIG. 6 is a cross-sectional diagram along line 6-6 in FIG. 5. The flow channel unit 60 has a laminated structure in which a base plate 86, a cavity plate 84, the diaphragm 82 and a protective plate 80 are layered in this order from the lower side in FIG. 6. The side walls of the pressure chambers 52 are constituted by the cavity plate 84, the lower surfaces of the pressure chambers 52 are constituted by the base plate 86, and the upper surfaces of the pressure chambers 52 are constituted by the diaphragm 82.

The common electrode 56 is formed on the whole of the surface of the diaphragm 82 (the surface on the side reverse to the side adjacent to the pressure chambers), and the piezoelectric bodies 55 are respectively arranged at positions corresponding to the pressure chambers 52, on the common electrode 56. Furthermore, the individual electrode 57 is formed on the upper surface of the piezoelectric body 55. In the present embodiment, a structure is adopted in which the piezoelectric bodies 55 are divided for the pressure chambers 52, thereby preventing cross-talk between the piezoelectric elements 58.

Recess sections 80*b* for protecting the piezoelectric elements 58 are formed in the protective plate 80. The recess sections 80*b* are formed to be deeper than the thickness of the piezoelectric elements 58 (in terms of the length in the vertical direction in FIG. 6), and wider than the width of the piezoelectric elements 58 (in terms of the length in the horizontal direction in FIG. 6), so that gaps 88 are created in the peripheral region of each piezoelectric element 58. Accordingly, restriction of the deformation of the piezoelectric elements 58 is prevented, and hence the ejection performance of the print head 50 is improved. Furthermore, the electrical wires 76 extending from the drive circuit 74 (see FIG. 5) are arranged in the protective plate 80. Each electrical wire 76 is electrically connected to the individual electrode 57 of the piezoelectric element 58 through an electrical connection section 90 made of solder, or the like. The common electrode 56 of the piezoelectric elements 58 is earthed.

Figure 7:
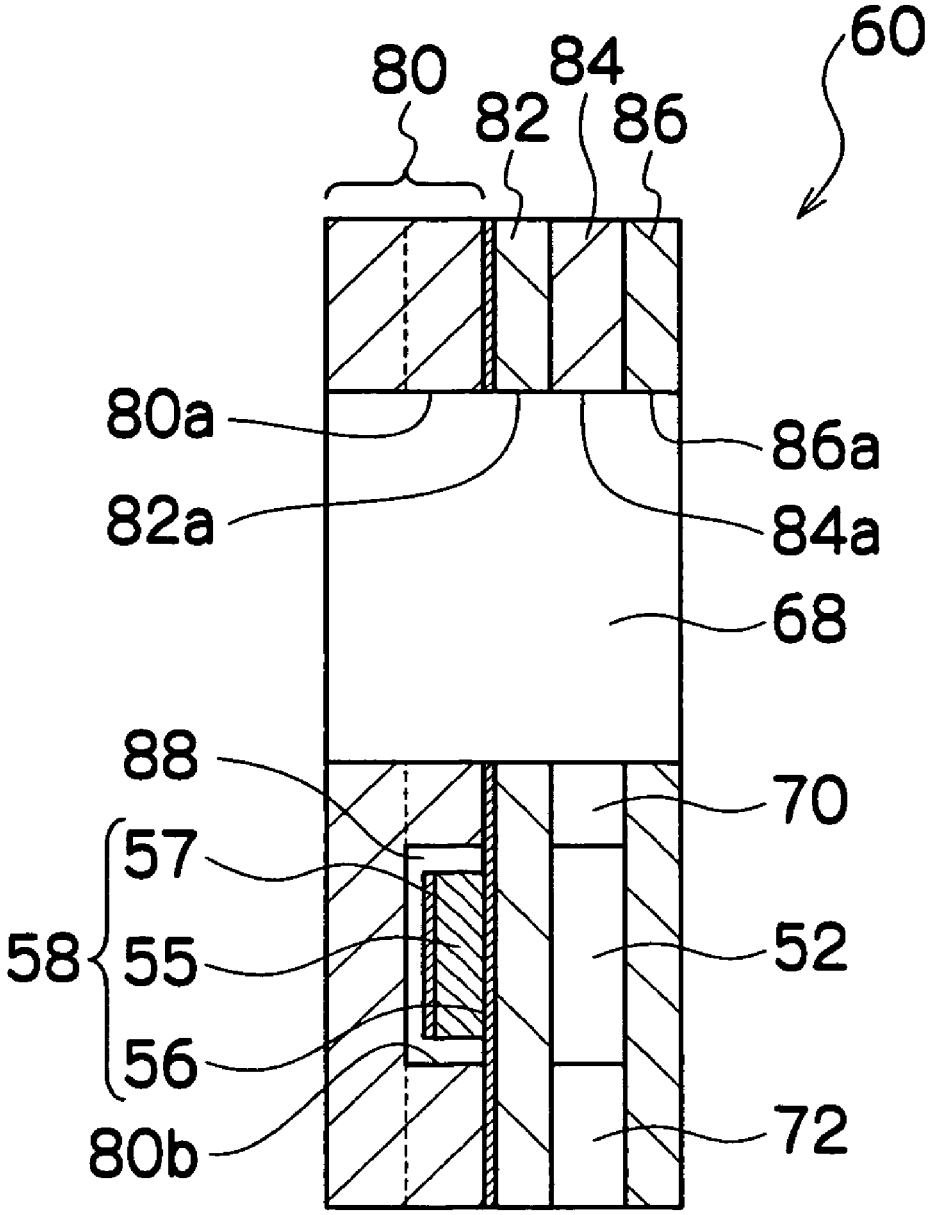
FIG. 7 is a cross-sectional diagram along line 7-7 in FIG. 5.

FIG. 7 is a cross-sectional diagram along line 7-7 in FIG. 5. The common flow channel 68 is formed so as to pass through both surfaces of the flow channel unit 60. Hole sections 80*a*, 82*a*, 84*a* and 86*a* which constitute a portion of the common flow channel 68 are formed respectively on the plate members 80, 82, 84 and 86 which constitute the flow channel unit 60. The common flow channel 68 is connected to each pressure chamber 52 through the supply port 70, and the pressure chamber 52 is connected to the nozzle 51 (not shown in FIG. 7) through the nozzle flow channel 72.

Figure 8A:
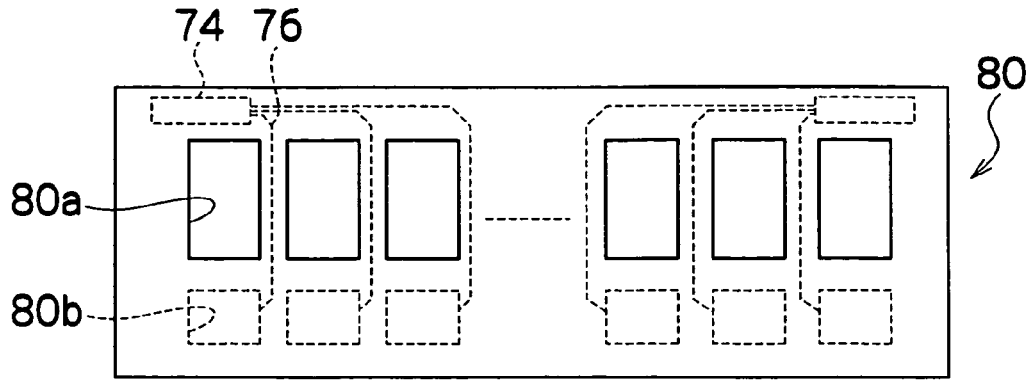
FIGS. 8A to 8D are plan diagrams of the plate members composing the flow channel unit.
Figure 8B:
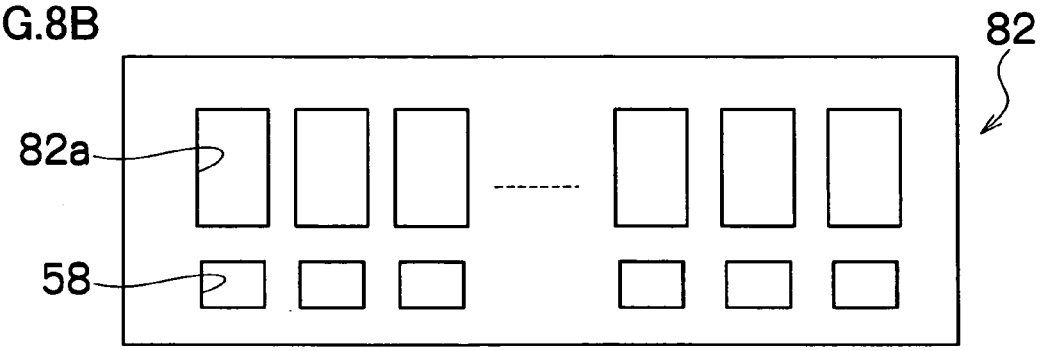
Figure 8C:
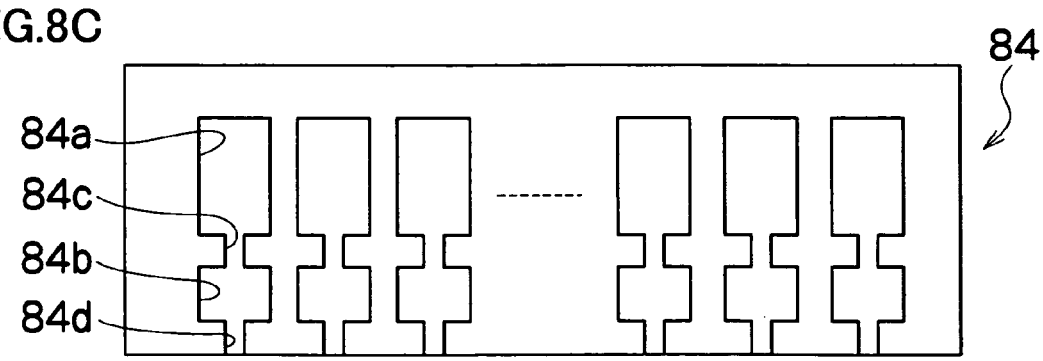
Figure 8D:
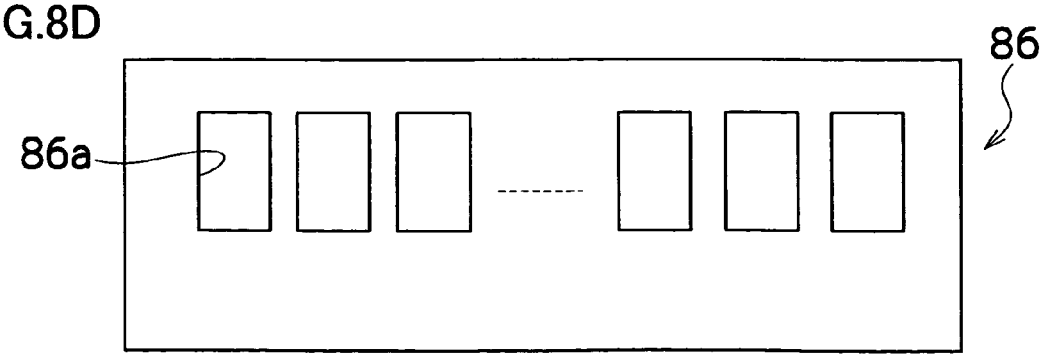

FIGS. 8A to 8D are plan diagrams of the plate members 80, 82, 84 and 86 constituting the flow channel unit 60. FIG. 8A shows the protective plate 80, FIG. 8B shows the diaphragm 82, FIG. 8C shows the cavity plate 84, and FIG. 8D shows the base plate 86. As stated previously, the hole sections 80*a*, 82*a*, 84*a*, and 86*a* which constitute a portion of the common flow channels 68 are formed respectively in the plate members 80, 82, 84 and 86. Furthermore, the drive circuit 74 and the electrical wires 76 are arranged in the protective plate 80, and the recess sections 80*b* for preventing restriction of the displacement of the piezoelectric elements 58 are also formed in the protective plate 80. The piezoelectric elements 58 are arranged on the diaphragm 82. Hole sections 84*b*, 84*c* and 84*d* corresponding respectively to the pressure chambers 52, the supply ports 70 and the nozzle flow channels 72 are formed in the cavity plate 84. The hole sections 84*b*, 84*c* and 84*d* formed in the cavity plate 84 may have a groove shape formed by half-etching, or the like, which does not pass through the cavity plate 84 in the thickness direction.

Figures 9A, 9B, 9C, 9D:
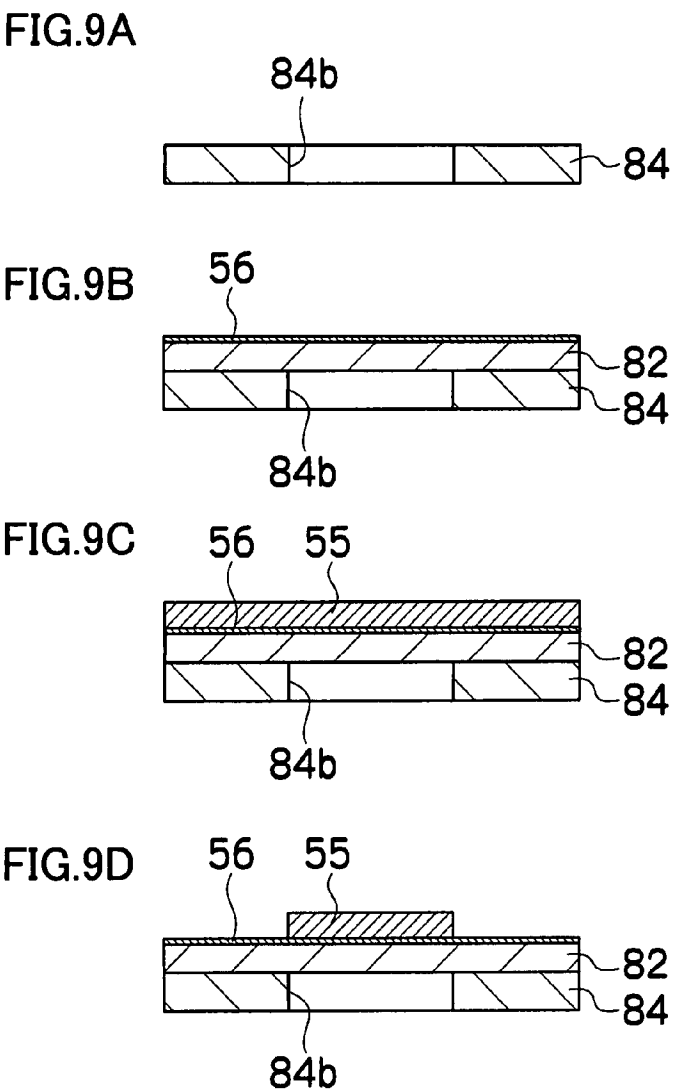
FIGS. 9A to 9G are illustrative diagrams showing steps of manufacturing the print head.

Next, the method of manufacturing the print head 50 according to the first embodiment is described with reference to FIGS. 9A to 9G Firstly, as shown in FIG. 9A, the cavity plate 84 is prepared, in which the hole sections 84*a*, 84*b*, 84*c* and 84*d* are formed (only the hole section 84*b* is shown in FIGS. 9A to 9G). The cavity plate 84 is made of stainless steel (SUS), for example, and the hole sections 84*a*, 84*b*, 84*c* and 84*d* are processed by a method such as etching.

Thereupon, as shown in FIG. 9B, the diaphragm 82 is bonded to the front surface of the cavity plate 84 (the upper side in FIG. 9B). For example, the plates are bonded by diffusion bonding at 1000° C. or below. Furthermore, the common electrode 56 is formed by a method such as sputtering, screen printing, or the like, over the whole surface of the diaphragm 82. A material such as chromium (Cr), nickel (Ni), gold (Au), tungsten (W), or the like, is used as the electrode material.

Figures 9E, 9F, 9G:
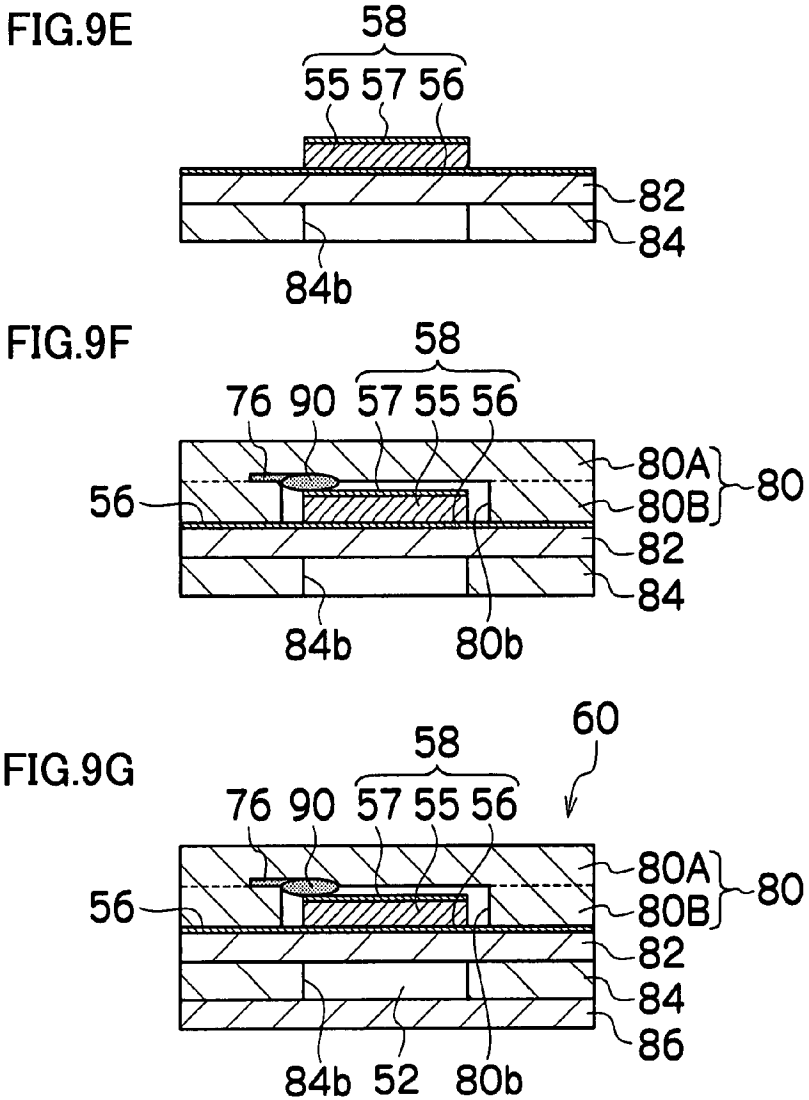

Then, the piezoelectric body 55 made of lead zirconate titanate, barium titanate, or the like, is formed by sputtering or an aerosol deposition method, over the whole surface of the common electrode 56 on the diaphragm 82 (see FIG. 9C). Thereupon, the piezoelectric body 55 is annealed at 600° C., or calcined at 800° C., and then patterning is carried out by dry-etching in order to leave the piezoelectric body 55 only in the portions corresponding to the hole sections 84*b* (see FIG. 9D). The step shown in FIG. 9C may be omitted in such a manner that patterned piezoelectric body 55 is formed on the common electrode 56, by means of a stencil mask method, or the like. Thereafter, as shown in FIG. 9E, the individual electrodes 57 are formed by a method such as sputtering, screen printing, or the like, on the surface (upper face) of the patterned piezoelectric bodies 55. The electrode material of the individual electrodes 57 is similar to that of the common electrode 56. In this way, the piezoelectric elements 58 constituted by the piezoelectric bodies 55 provided with the individual electrode 57 and the common electrode 56 on the upper and lower surfaces are arranged so as to correspond to the hole sections 84*b*.

Next, as shown in FIG. 9F, the protective plate 80 formed with the recess sections 80*b*, which prevent restriction of the displacement of the piezoelectric elements 58, and the electrical wires 76 having a prescribed pattern, is prepared. The protective plate 80 according to the present embodiment comprises an integrated multi-layer flexible printed circuit (FPC) 80A having the electrical wires 76, and a polyimide (PI) resin layer 80B constituting the side wall of the recess sections 80*b*. The electrical connection sections 90, which are electrically connected to ends of the electrical wires 76, are arranged in advance in the wall corner sections of the recess sections 80*b*. The electrical connection sections 90 are constituted by solder, or the like. The protective plate 80 is bonded by means of adhesive, or the like, onto the front surface of the diaphragm 82 (across the common electrode 56), in such a manner that the electrical connection sections 90 are electrically connected to the individual electrodes 57. It is also possible to form the PI resin layer 80B of a prescribed shape on the front surface of the diaphragm 82 by means of a commonly known photolithography technique, for example, and to then bond the multi-layer FPC 80A thereon.

Next, as shown in FIG. 9G, the base plate 86 made of stainless steel (SUS), for example, is bonded to the rear surface of the cavity plate 84 (on the side opposite to the side adjacent to the diaphragm 82), by means of adhesive, or the like. In the step in FIG. 9B, it is also possible to bond the diaphragm 82, the cavity plate 84 and the base plate 86 by diffusion bonding. Thus, the flow channel unit 60 constituted by the protective plate 80, the diaphragm 82, the cavity plate 84, and the base plate 86 is manufactured.

After manufacturing a plurality of flow channel units 60 in this way, the plurality of flow channel units 60 are layered together as shown in FIG. 4, and the partition plates 62 and 64 are bonded so as to face each other across the bundle of flow channel units 60 from either side. Finally, the nozzle plate 66 is bonded while aligning the nozzles 51 on the nozzle plate 66 with the nozzle flow channels 72 of the flow channel units 60. Thus, the print head 50 according to the first embodiment is manufactured.

Next, the action of the print head 50 according to the first embodiment of the present invention is described. The ink in the common flow channel 68 is supplied to the pressure chambers 52 through the supply ports 70. When a drive signal (drive voltage) corresponding to the image data is applied to the individual electrode 57 of each piezoelectric element 58, then the piezoelectric element 58 deforms in such a manner that the diaphragm 82 is caused to bend in toward the pressure chamber 52. Consequently, the ink inside the pressure chamber 52 is pressurized and an ink droplet is ejected from the nozzle 51. After ejecting the ink, the piezoelectric element 58 returns to its original state, and new ink is refilled into the pressure chamber 52 from the common flow channel 68. These ink ejection operation and refill operation are repeated.

In the print head 50 according to the first embodiment, the plurality of piezoelectric element rows, each comprising the plurality of piezoelectric elements 58 arranged in the substantially perpendicular direction (main scanning direction) with respect to the thickness direction of the thin plate-shaped piezoelectric elements 58 (sub-scanning direction), are arranged in the thickness direction of the piezoelectric elements 58 (sub-scanning direction), and therefore, the head size in the thickness direction of the piezoelectric elements 58, namely, the sub-scanning direction, is reduced in comparison with the head in the related art (see FIG. 20) in which the piezoelectric elements are arranged in a two-dimensional configuration in the same plane. Consequently, it is possible to reduce the visibility of streaks produced in the printed image around the positions corresponding to the junctures in the print head 50.

Figure 10B:
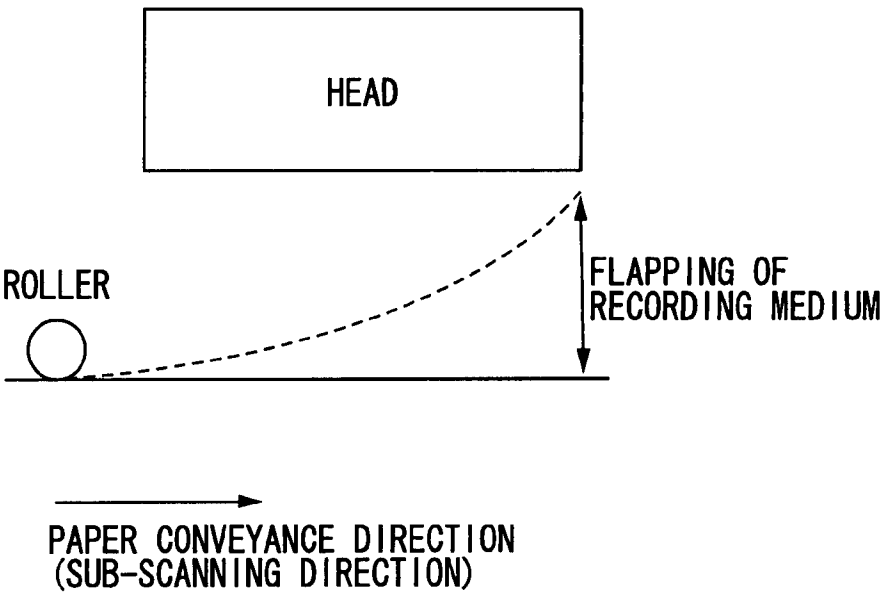
FIG.10B RELATED ART
FIGS. 10A and 10B are illustrative diagrams for describing the effects of the embodiment of the present invention.
Figure 10A:
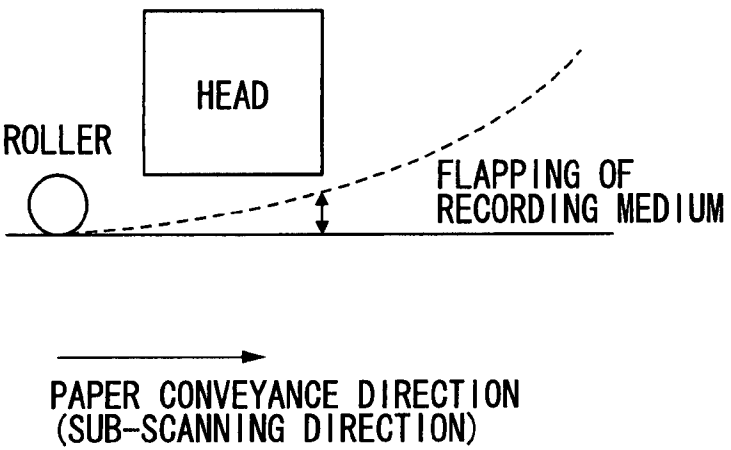

Moreover, since the maximum flapping of the recording medium that should be considered in the design is reduced due to the reduced head size in the sub-scanning direction, then the distance between the head and the recording medium (the "throw distance") can be shortened as shown in FIG. 10A in the head to which the present invention is applied, in comparison with the related art shown in FIG. 10B. Consequently, the landing accuracy of the ink droplets ejected from the nozzles 51 is improved, and the landing position errors, and errors within the same ink color or between different ink colors are reduced.

Furthermore, since the electrical wires 76 for driving the piezoelectric elements 58 are arranged on the protective plate 80, which is different to the surface where the piezoelectric elements 58 are disposed (namely, the diaphragm 82), then it is possible to ensure suitable space for laying the electrical wires, and hence the difficulty of wiring is reduced. In the head in the related art, a plurality of piezoelectric elements are arranged in a two-dimensional configuration in the same plane as described above, and therefore it is necessary to provide electrical wiring (internal wiring) for driving the piezoelectric elements in this plane, for example, and hence there is a problem in that the space for the electrical wiring is insufficient and the task of wiring becomes highly difficult. However, in the print head 50 according to the present embodiment, these problems are resolved, and the composition suited to the high-density arrangement is obtained.

The first embodiment shows the composition in which the drive circuits 74 are provided respectively in the flow channel units 60, but the present invention is not limited to this. For example, in order to reduce the number of drive circuits, it is also possible to use via wires which bundle together the electrical wires (external wires 76) of the plurality of flow channel units 60. Moreover, it is also possible to provide external wiring connection sections on each of the flow channel units 60, in such a manner that the flow channel units 60 can be connected electrically to an externally situated drive circuit through external wiring such as low density FPC.

Furthermore, in the print head 50 according to the first embodiment, it is not necessary to process fine and highly precise holes of the same kind as the nozzles 51, in the diaphragm 82. Although processing is required in the diaphragm 82 to create the hole sections 82*a* corresponding to the common flow channels 68, this can be carried out readily by pressing, or the like. Therefore, since there is greater freedom of choice of the material used for the diaphragm 82, then a heat-treatable diaphragm (made of yttria-stabilized zirconia (YSZ), for example) can be used, and it becomes possible to carry out high-temperature annealing of the piezoelectric bodies 55 formed by the aerosol method, thus leading to improved performance of the piezoelectric elements 58.

Second Embodiment

Figure 11:
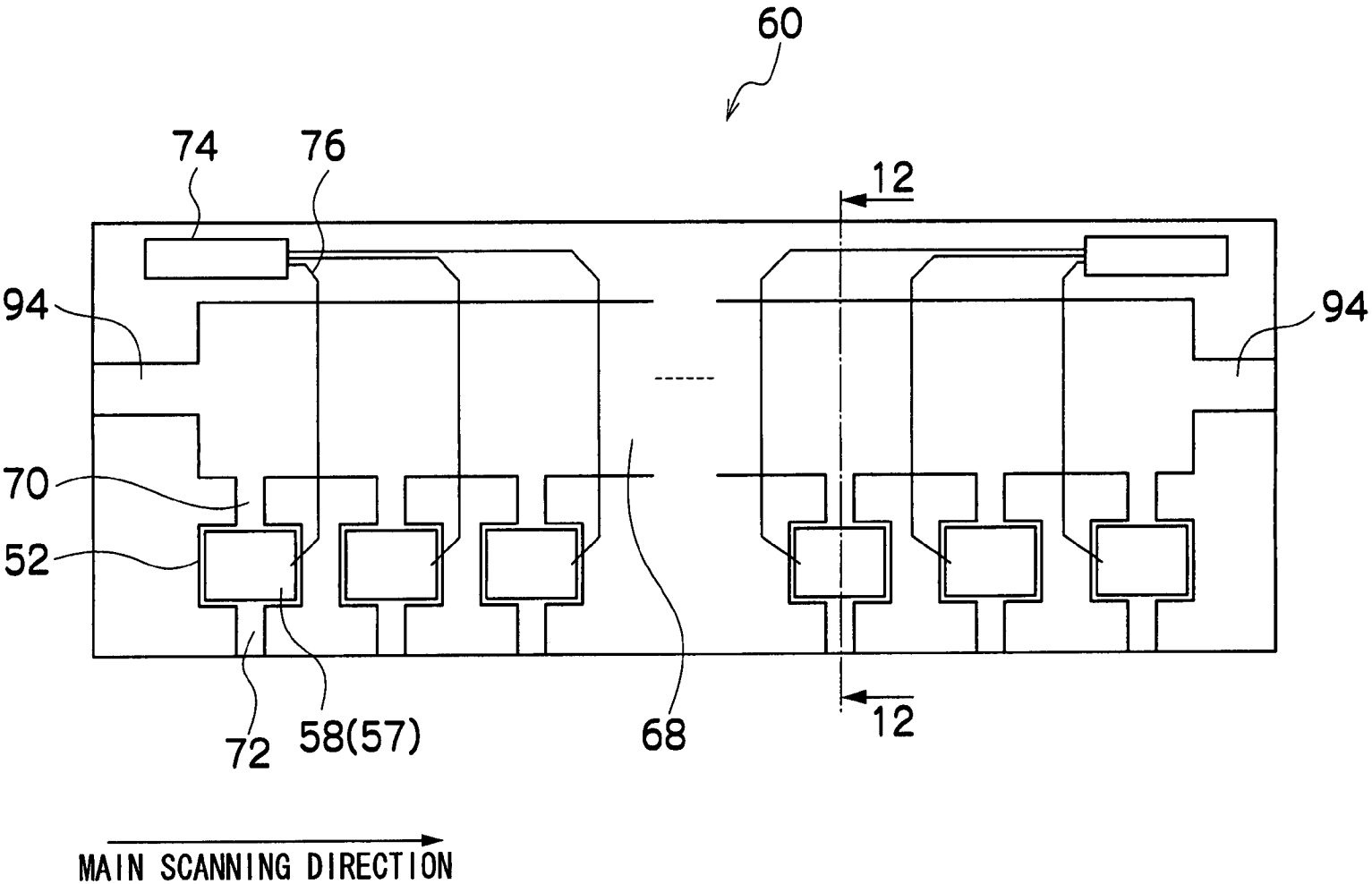
FIG. 11 is a plan view perspective diagram of a flow channel unit constituting the print head according to a second embodiment of the present invention.
Figure 12:
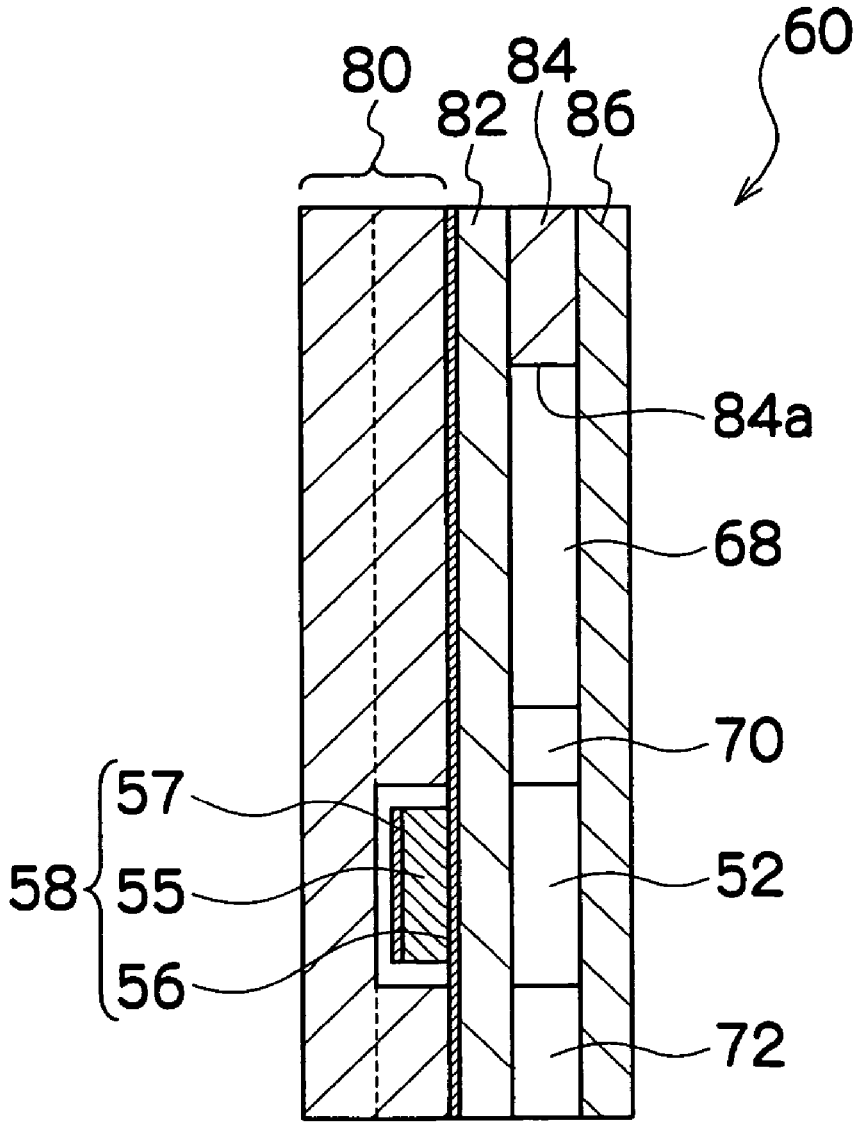
FIG. 12 is a cross-sectional diagram along line 12-12 in FIG. 11.

FIG. 11 is a plan view perspective diagram of a flow channel unit 60 that constitutes the print head 50 according to a second embodiment of the present invention, and FIG. 12 is a sectional view along line 12-12 in FIG. 11. In the second embodiment, the common flow channel 68 extending in the main scanning direction is formed in the flow channel unit 60, and the common flow channel 68 is connected to the pressure chambers 52 arranged in the main scanning direction through the supply ports 70. Ink supply ports 94 are formed at both ends of the common flow channel 68 in the main scanning direction. When ink is filled initially into the head, the ink is supplied from both of the two ink supply ports 94. Furthermore, during print standby, in order to prevent increase in the viscosity of the ink, the ink is supplied from one of the ink supply ports 94, and the ink is expelled from the other of the ink supply ports 94, thereby circulating the ink through the head. As shown in FIG. 12, the common flow channel 68 has a structure in which the faces of the hole sections 84*a* formed in the cavity plate 84 are sealed between the diaphragm 82 and the base plate 86, and hence the common flow channel 68 is closed inside the flow channel unit 60. More specifically, the common flow channel 68 in the first embodiment is formed so as to pass through both surfaces of the flow channel units 60, in such a manner that the common flow channel 68 covers the plurality of flow channel units 60; whereas the common flow channel 68 in the second embodiment extending in the main scanning direction is formed in each of the flow channel units 60. The remaining composition is the same as that of the first embodiment and further description thereof is omitted here.

Figure 13:
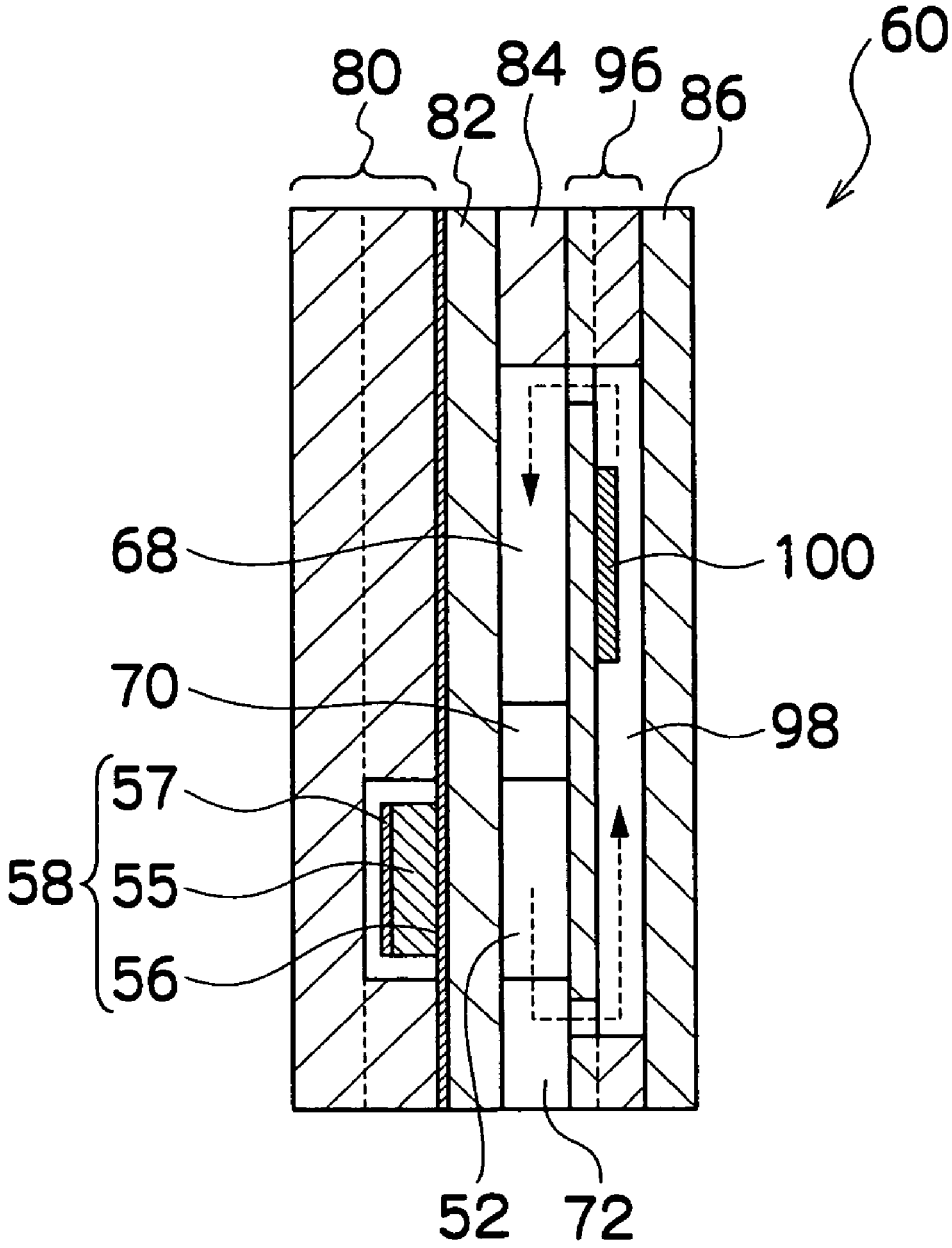
FIG. 13 is a cross-sectional diagram showing a modification of the flow channel unit constituting the print head according to the second embodiment.

FIG. 13 shows a modification of the flow channel unit 60 constituting the print head 50 according to the second embodiment. The flow channel unit 60 shown in FIG. 13 includes a second cavity plate 96 arranged between the cavity plate (first cavity plate) 84 and the base plate 86. A second flow channel 98 is formed in the second cavity plate 96, and one end of the second flow channel 98 (the lower end in FIG. 13) is connected to the nozzle flow channel 72, while the other end of the second flow channel 98 (the upper end in FIG. 13) is connected to the common flow channel 68. Furthermore, a thermistor 100 and a heater (not shown) are arranged on a wall of the second flow channel 98. Consequently, the ink inside the flow channel unit 60 can be circulated along the second flow channel 98, as indicated by the dashed arrows in FIG. 13, and furthermore, the ink temperature can be kept uniform by means of temperature control using the heater and the thermistor 100. Therefore, increase in the viscosity of the ink can be prevented. Accordingly, stable ejection can be achieved even in cases where high-viscosity ink is used.

Figure 14B:
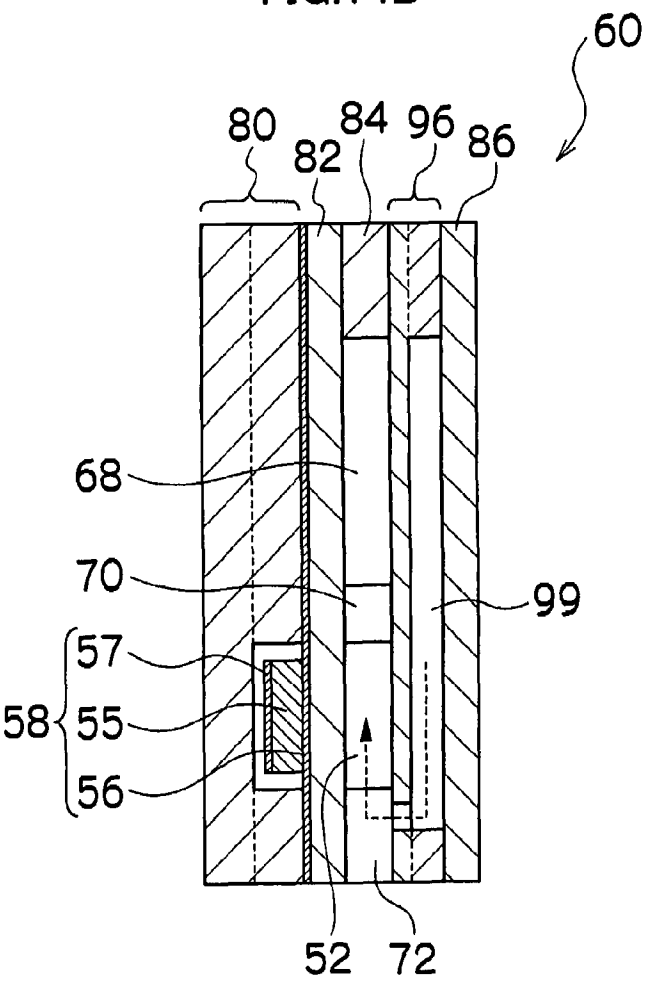
FIGS. 14A and 14B are cross-sectional diagrams showing a further modification of the flow channel unit constituting the print head according to the second embodiment.
Figure 14A:
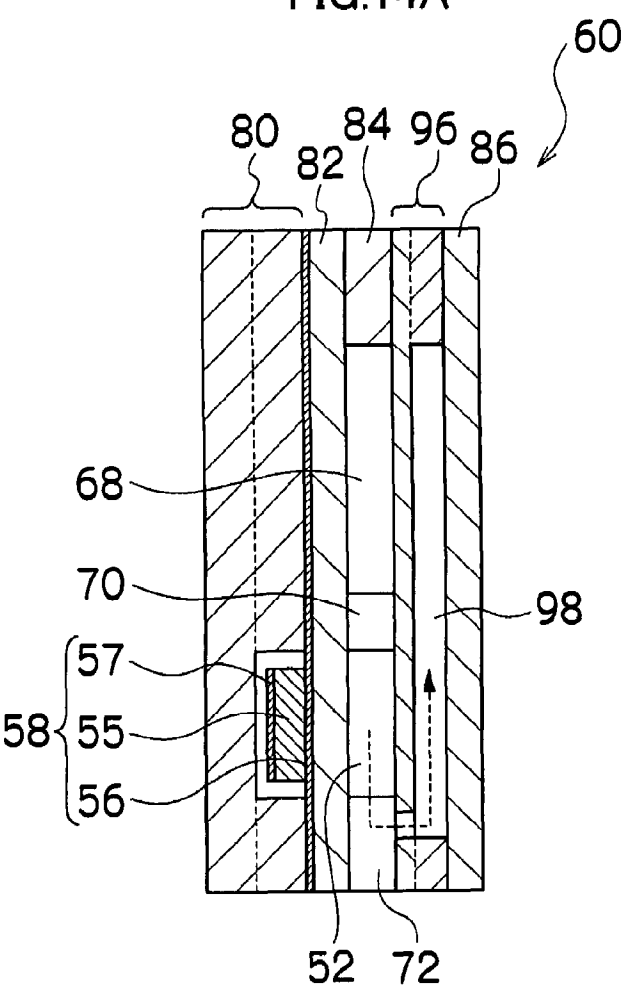

FIGS. 14A and 14B show a further modification of the flow channel unit 60 constituting the print head 50 according to the second embodiment. FIGS. 14A and 14B show two different cross-sections of the same pressure chamber 52. In the print head 50 shown in FIGS. 14A and 14B, the second flow channel 98 is provided as shown in FIG. 14A, and a third flow channel 99 is provided as shown in FIG. 14B. The second flow channel 98 is a discharge side flow channel, which discharges the ink from the nozzle flow channel 72, whereas the third flow channel 99 is a supply side flow channel, which supplies the ink to the nozzle flow channel 72. The second flow channels 98 and the third flow channels 99 corresponding to the pressure chambers 52 may be constituted in such a manner that they are connected, wholly or partially, on the upper side in FIG. 6, for example. Furthermore, it is also possible to construct a "joined-up" structure in which the second flow channel 98 corresponding to one pressure chamber 52 is connected to the third flow channel 99 corresponding to another, adjacently situated pressure chamber 52, and the third flow channel 99 corresponding to the one pressure chamber 52 is connected to the second flow channel 98 corresponding to the other, adjacently situated pressure chamber 52, so as to form a unicursal structure. In the print head 50 of this kind, due to the pressure interactions in the nozzle flow channels 72, the refill recovery time is shortened and the ejection frequency can be improved.

Third Embodiment

Figure 15:
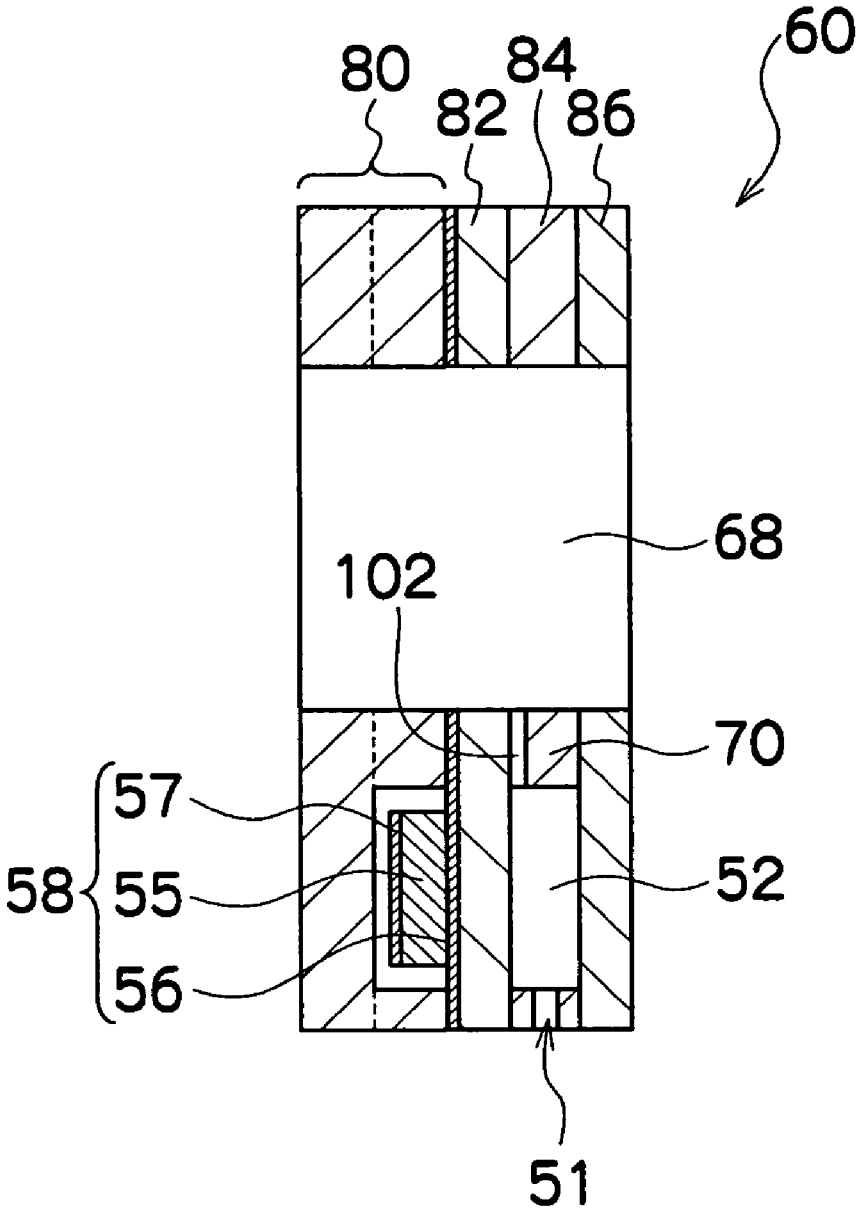
FIG. 15 is a cross-sectional diagram showing a flow channel unit constituting the print head according to a third embodiment of the present invention.

FIG. 15 shows a cross-sectional diagram of a flow channel unit 60 constituting the print head 50 according to a third embodiment of the present invention. In the third embodiment, nozzles 51 and supply regulators 102 are provided in the flow channel unit 60. The nozzles 51 and the supply regulators 102 are formed by hole sections or groove sections formed in the cavity plate 84 by wet etching, for example. The nozzle 51 is a hole section formed so as to pass in a perpendicular direction through the lower side wall of the pressure chamber 52 in FIG. 15, and the supply regulator 102 is a groove section formed in the upper side wall of the pressure chamber 52 in FIG. 15. In the third embodiment, the nozzle plate 66 in the first embodiment (see FIG. 2) is not required. The remaining composition is the same as that of the first embodiment and further description thereof is omitted here.

Fourth Embodiment

Figure 16:
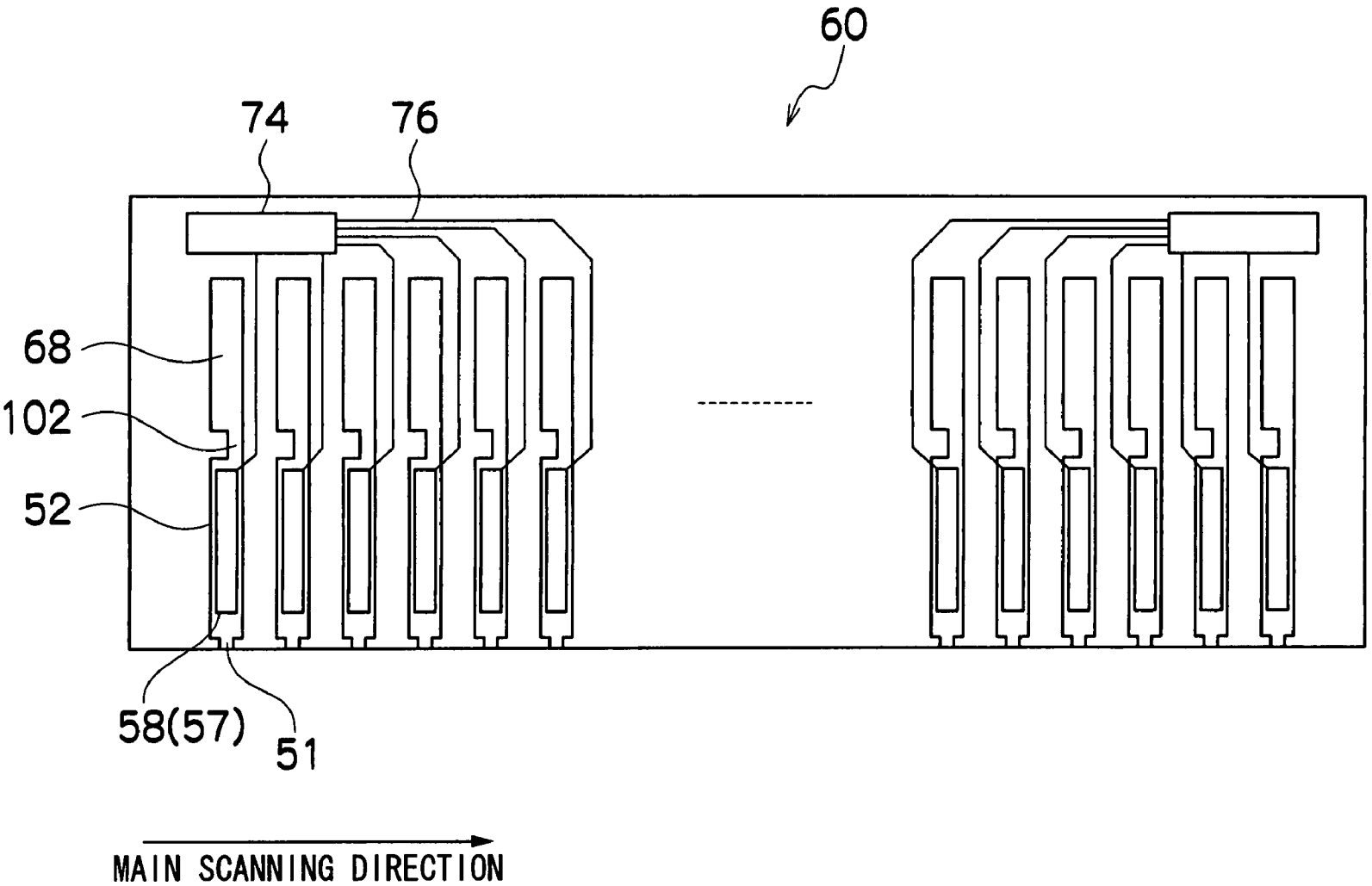
FIG. 16 is a plan view perspective diagram of a flow channel unit constituting the print head according to a fourth embodiment of the present invention.

FIG. 16 is a plan view perspective diagram of a flow channel unit 60 constituting the print head 50 according to a fourth embodiment of the present invention. In the flow channel unit 60 according to the fourth embodiment, similarly to the third embodiment, the nozzles 51 and the supply regulators 102 are provided, and furthermore, the pressure chambers 52 and the piezoelectric elements 58 corresponding to same are formed in an elongated shape in the vertical direction in FIG. 16. Consequently, it is possible to ensure sufficient surface area of the piezoelectric elements 58 in order to obtain a desired ejection force, and furthermore, it is possible to reduce the pitch of the piezoelectric elements 58 and the pressure chambers 52 in the main scanning direction. Therefore, the nozzle rows formed in the flow channel unit 60 can be arranged at a high density to achieve a nozzle density of 200 npi or above.

Figure 17:
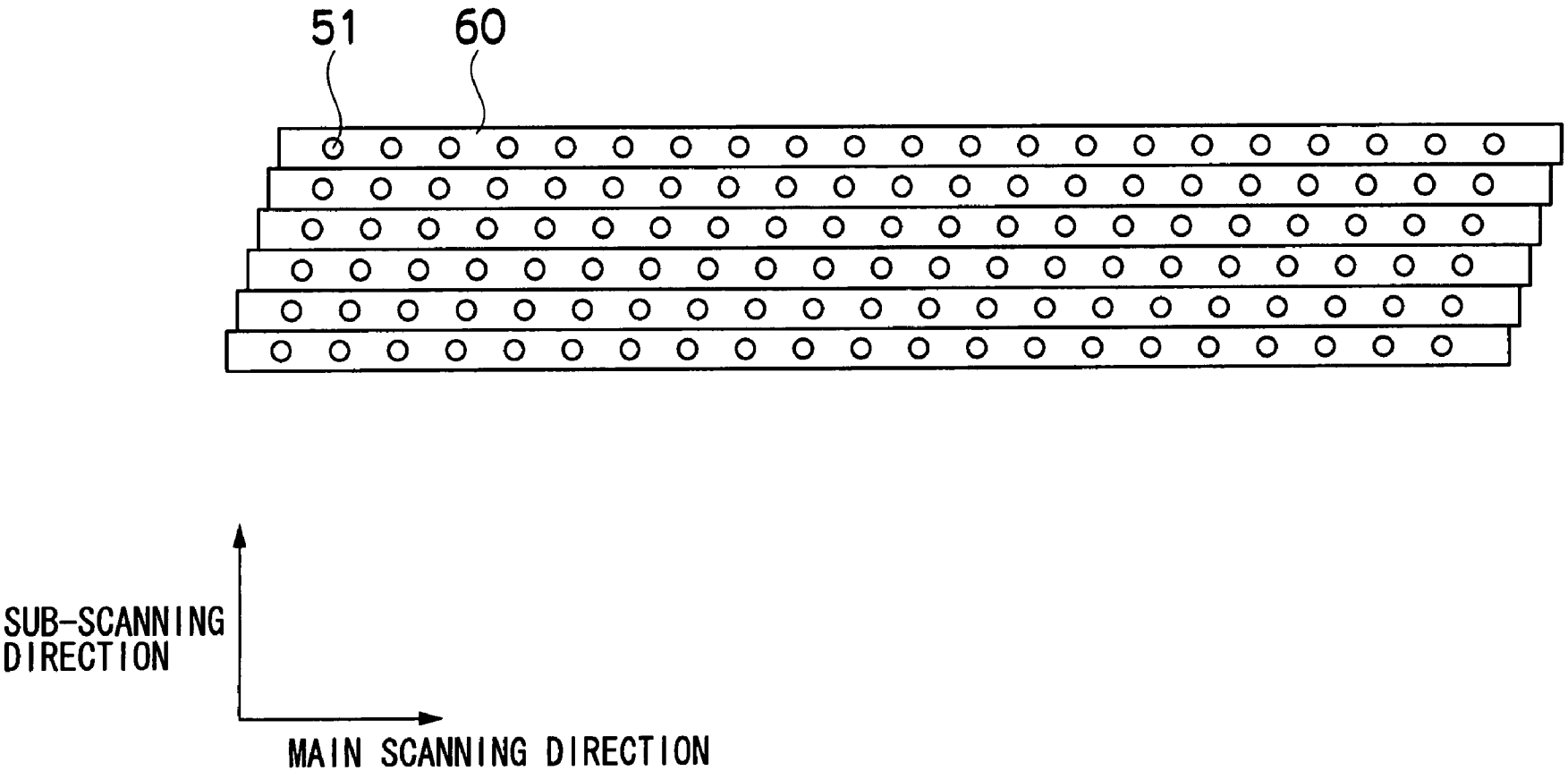
FIG. 17 is a plan diagram showing an embodiment of the layering structure of the flow channel units in FIG. 16.

FIG. 17 is a plan diagram showing an embodiment of the layering structure of the flow channel units 60 in FIG. 16, and shows a state as viewed from the side where the nozzles 51 are formed. In the layering structure shown in FIG. 17, the arrangement positions of the flow channel units 60 are shifted successively by a prescribed amount in the main scanning direction. As described above, since the nozzle rows in the flow channel units 60 are of the high density, the positional displacement between the flow channel units 60 in the main scanning direction is not near the perceptible spatial frequency range, and therefore, even if there is slight positional displacement between the flow channel units 60, this is tolerable.

Figure 18:
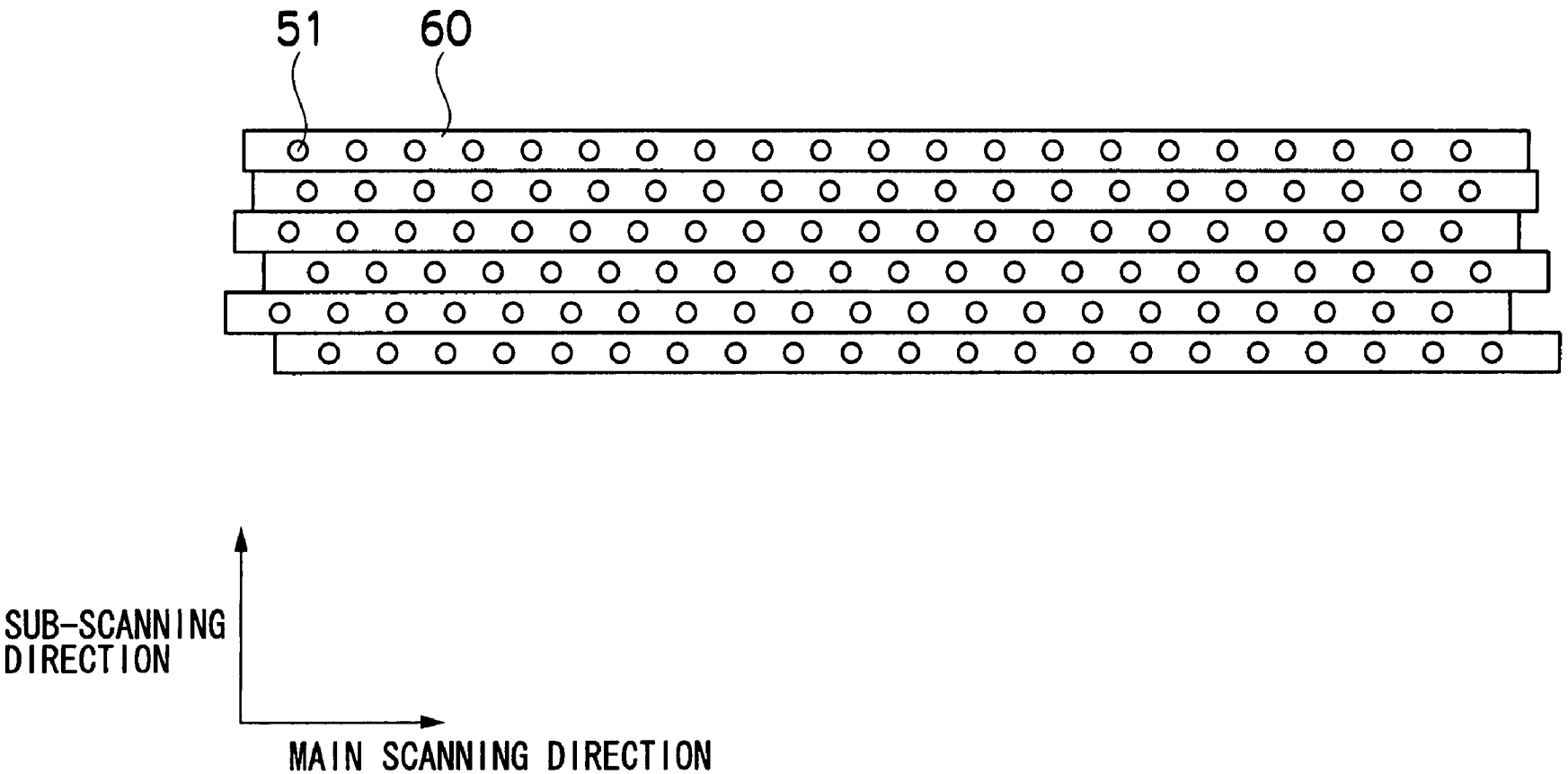
FIG. 18 is a plan diagram showing a further embodiment of the layering structure of the flow channel units in FIG. 16.

FIG. 17 shows the composition in which the amount of shift in the main scanning direction is uniform, between one flow channel unit 60 and the adjacent flow channel unit 60, but the composition is not limited to this, and it is also possible to adopt another composition that creates a uniform nozzle pitch in the projected nozzle row obtained by projecting the nozzles in the main scanning direction. For example, as shown by a further layering composition shown in FIG. 18, it is possible to adopt the composition in which the amounts of shift of the flow channel units 60 are not uniform.

Fifth Embodiment

Figure 19:
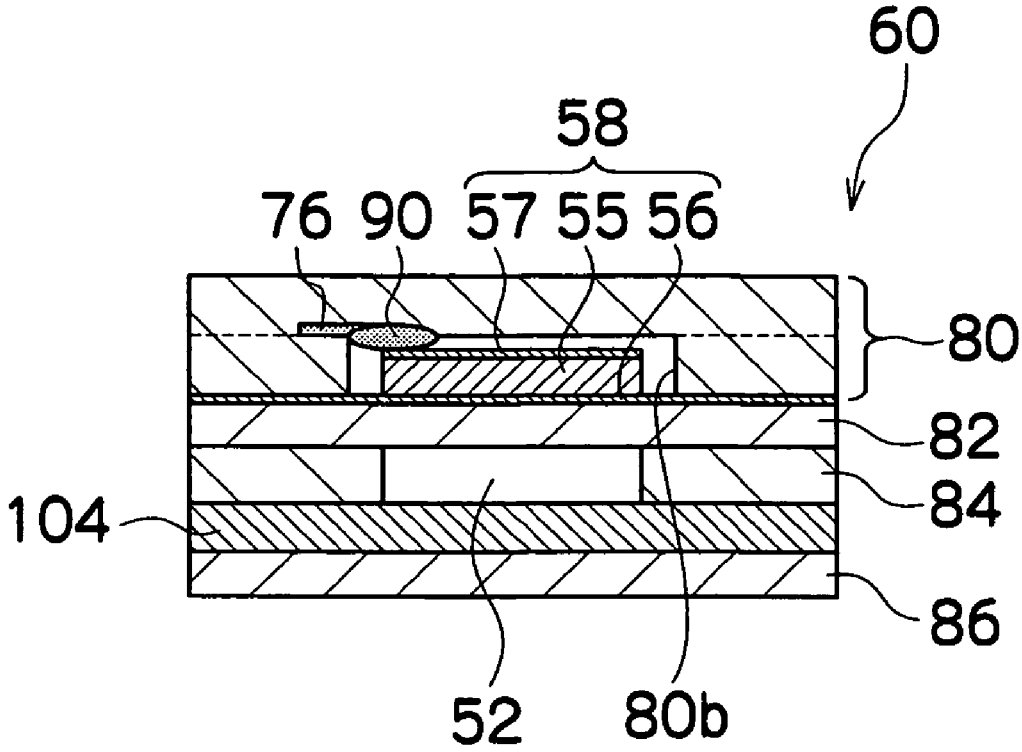
FIG. 19 is a cross-sectional diagram of a flow channel unit constituting the print head according to a fifth embodiment of the present invention.

FIG. 19 shows a cross-sectional diagram of a flow channel plate 60 constituting the print head 50 according to a fifth embodiment of the present invention. In the fifth embodiment, a piezoelectric sensor layer 104 is provided between the cavity plate 84 and the base plate 86. The piezoelectric sensor layer 104 is principally made of piezoelectric resin, for example, and is capable of measuring pressure variation in the ink caused, for instance, by bubbles existing in the pressure chambers 52. Accordingly, the ejection quality of the print head 50 can be improved. The remaining composition is the same as that of the first embodiment and further description thereof is omitted here.

In each of the second to fifth embodiments, similar beneficial effects to those of the first embodiment are achieved, in that the composition having the smaller head size in the sub-scanning direction is achieved in comparison with the head in the related art, and the visibility of streaks occurring in the printed image around the positions corresponding to the juncture positions of the print head 50 can be reduced.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a plurality of nozzles through which liquid is ejected in an ejection direction;

a plurality of pressure chambers which are connected respectively to the nozzles and filled with the liquid; and a plurality of piezoelectric elements which are provided respectively for the pressure chambers, the piezoelectric elements deforming to pressurize and cause the liquid in the pressure chambers to be ejected through the nozzles, the piezoelectric elements being substantially thin plate-shaped and layered in a thickness direction of the piezoelectric elements, the plurality of pressure chambers corresponding to the plurality of piezoelectric elements being arranged in the thickness direction of the piezoelectric elements, the thickness direction being substantially perpendicular to the ejection direction.

2. The liquid ejection head as defined in claim 1, wherein:

the piezoelectric elements are polarized in the thickness direction of the piezoelectric elements; and the piezoelectric elements deform when an electric field is applied in the thickness direction.

3. The liquid ejection head as defined in claim 1, wherein:

the piezoelectric elements are arranged in a plurality of rows substantially perpendicular to the thickness direction of the piezoelectric elements; and the rows are arranged in the thickness direction.

4. The liquid ejection head as defined in claim 1, wherein:

the liquid ejection head is a line head in which the nozzles are two-dimensionally arranged through a length corresponding to a full width of a recording medium; and the thickness direction of the piezoelectric elements is parallel to a direction of relative conveyance of the recording medium with respect to the liquid ejection head.

5. The liquid ejection head as defined in claim 1, further comprising a plurality of unit members which include the piezoelectric elements and the pressure chambers, the unit members being substantially thin plate-shaped and layered in the thickness direction of the piezoelectric elements.

6. The liquid ejection head as defined in claim 5, wherein each of the unit members has a flow channel through which the liquid circulates.

7. The liquid ejection head as defined in claim 5, wherein each of the unit members further includes a plurality of pressure sensors which determine pressure change in the liquid filled in the pressure chambers, respectively.

8. An image forming apparatus, comprising the liquid ejection head as defined in claim 1.

9. A liquid ejection head, comprising:

a plurality of nozzles through which liquid is ejected in an ejection direction;

a plurality of pressure chambers which are connected respectively to the nozzles and filled with the liquid;

a plurality of piezoelectric elements which are provided respectively for the pressure chambers, the piezoelectric elements deforming to pressurize and cause the liquid in the pressure chambers to be ejected through the nozzles, the piezoelectric elements being substantially thin plate-shaped and layered in a thickness direction of the piezoelectric elements, the thickness direction being substantially perpendicular to the ejection direction;

a plurality of unit members which include the piezoelectric elements and the pressure chambers, the unit members being substantially thin plate-shaped and layered in the thickness direction of the piezoelectric elements; and a nozzle plate which is formed with holes respectively corresponding to the nozzles and is arranged on a side face of the layered unit members, the side face being parallel to the thickness direction of the piezoelectric elements.

10. The liquid ejection head as defined in claim 9, wherein each of the unit members further includes:

a cavity plate which is formed with holes corresponding respectively to the pressure chambers;

a diaphragm which seals off a face of each of the holes in the cavity plate, the piezoelectric elements being disposed on a side of the diaphragm reverse to a side thereof adjacent to the holes in the cavity plate; and a base plate which seals off the other face of each of the holes in the cavity plate.

11. The liquid ejection head as defined in claim 10, wherein the cavity plate has supply ports through which the liquid is supplied to the pressure chambers.

12. The liquid ejection head as defined in claim 10, wherein each of the unit members further includes a protective plate which is formed with at least one of recesses and grooves for preventing restriction of deformation of the piezoelectric elements.

13. The liquid ejection head as defined in claim 12, wherein each of the unit members further includes electrical wires through which driving signals are applied to the piezoelectric elements, the electrical wires being arranged on at least one of the protective plate and the cavity plate.

14. The liquid ejection head as defined in claim 13, wherein each of the unit members further includes a drive circuit which drives the piezoelectric elements, the drive circuit being arranged on the at least one of the protective plate and the cavity plate.

* * * * *